US011306972B2

(12) United States Patent
Singh

(10) Patent No.: US 11,306,972 B2
(45) Date of Patent: Apr. 19, 2022

(54) SHELL AND TUBE HEAT EXCHANGERS

(71) Applicant: HOLTEC INTERNATIONAL, Camden, NJ (US)

(72) Inventor: Krishna P. Singh, Hobe Sound, FL (US)

(73) Assignee: HOLTEC INTERNATIONAL

( * ) Notice: Subject to any disclaimer, the term of this patent is extended or adjusted under 35 U.S.C. 154(b) by 104 days.

(21) Appl. No.: 16/173,313

(22) Filed: Oct. 29, 2018

(65) Prior Publication Data

US 2019/0128613 A1 May 2, 2019

Related U.S. Application Data

(60) Provisional application No. 62/630,573, filed on Feb. 14, 2018, provisional application No. 62/580,125, filed on Nov. 1, 2017.

(51) Int. Cl.
*F28D 7/00* (2006.01)
*F28D 7/16* (2006.01)
(Continued)

(52) U.S. Cl.
CPC ..... *F28D 7/1638* (2013.01); *F28D 7/005* (2013.01); *F28D 7/0075* (2013.01); *F28D 7/06* (2013.01);
(Continued)

(58) Field of Classification Search
CPC ..... F28D 7/1638; F28D 7/06; F28D 7/005; F28D 7/0075; F28D 7/08; F28F 21/0081;
(Continued)

(56) References Cited

U.S. PATENT DOCUMENTS 1,814,010 A 7/1931 Snow
2,061,980 A 11/1936 Price
(Continued)

FOREIGN PATENT DOCUMENTS

JP S60243494 A * 12/1985 ..... F28D 7/08
WO 2004/052524 6/2004

OTHER PUBLICATIONS

International Search Report and Written Opinion, Patent Cooperation Treaty, dated Jan. 15, 2019, pp. 1-13.
(Continued)

*Primary Examiner* — Harry E Arant
(74) *Attorney, Agent, or Firm* — The Belles Group, P.C.

(57) ABSTRACT

A heat exchanger in one aspect includes a longitudinal shell and a transverse shell oriented transversely thereto. A J-shaped tube bundle carrying a tube-side fluid extends through the longitudinal and transverse shells from a first tubesheet in the longitudinal shell to a second tubesheet in the transverse shell. The first and second tubesheets are oriented perpendicular to each other. In a related aspect a dual heat exchanger unit includes a first longitudinal shell, a second longitudinal shell, and a common transverse shell extending transversely between and fluidly coupled to the longitudinal shells. The longitudinal shells may be parallel to each other. The shells are fluidly coupled directly together to form a common shell-side space between pairs of inlet and outlet tubesheets. A pair of J-shaped tube bundles is disposed in the dual heat exchanger unit for heating two tube-side fluids.

21 Claims, 14 Drawing Sheets

(51) Int. Cl.

| | |
|---|---|
| ***F28D 7/06*** | (2006.01) |
| ***F28F 21/08*** | (2006.01) |
| ***F28F 9/26*** | (2006.01) |
| ***F28D 7/08*** | (2006.01) |

(52) U.S. Cl.
CPC ..... *F28D 7/08* (2013.01); *F28F 9/26* (2013.01); *F28F 21/081* (2013.01); *F28F 21/082* (2013.01); *F28F 2265/26* (2013.01); *F28F 2275/06* (2013.01)

(58) Field of Classification Search
CPC ..... F28F 9/26; F28F 2265/26; F28F 2275/06; F28F 21/082; F28F 9/00; F28F 21/081; F22B 1/066
See application file for complete search history.

(56) References Cited

U.S. PATENT DOCUMENTS

| | | | | | |
|---|---|---|---|---|---|
| 3,118,497 | A * | 1/1964 | Olson | F28F 9/00 | 165/157 |
| 3,125,161 | A * | 3/1964 | Romanos | F22G 3/009 | 165/159 |
| 3,333,630 | A * | 8/1967 | Charcharos | F28D 7/06 | 165/158 |
| 3,702,633 | A * | 11/1972 | Csathy | F28F 9/00 | 165/159 |
| 3,797,566 | A | 3/1974 | Credoz et al. | | |
| 3,841,271 | A | 10/1974 | Massaro | | |
| 3,842,904 | A | 10/1974 | Gardenier | | |
| 4,163,470 | A | 8/1979 | Johnsen et al. | | |
| 4,237,968 | A * | 12/1980 | Duke | F22B 1/066 | 165/70 |
| 4,276,928 | A | 7/1981 | Blaskowski | | |
| 4,436,146 | A | 3/1984 | Smolarek | | |
| 5,296,199 | A | 3/1994 | Kwok et al. | | |
| 5,323,849 | A | 6/1994 | Korczynski, Jr. et al. | | |
| 5,579,836 | A | 12/1996 | Maruyama | | |
| 6,273,180 | B1 | 8/2001 | Joshi et al. | | |
| 8,789,389 | B2 | 7/2014 | Ogasawara et al. | | |
| 9,146,045 | B2 | 9/2015 | Miglio | | |
| 2007/0079956 | A1 * | 4/2007 | Howard | F28D 7/06 | 165/158 |
| 2010/0300653 | A1 | 12/2010 | Bonner | | |
| 2012/0199323 | A1 | 8/2012 | Pazzaglia et al. | | |
| 2013/0269910 | A1 | 10/2013 | De Piero et al. | | |
| 2016/0291570 | A1 | 10/2016 | Iriguchi et al. | | |

OTHER PUBLICATIONS

International Search Report and Written Opinion for International Application No. PCT/US2019/026898 dated Aug. 2, 2019.

* cited by examiner

SHELL AND TUBE HEAT EXCHANGERS

CROSS-REFERENCE TO RELATED APPLICATIONS

The present application claims the benefit of priority to U.S. Provisional Application No. 62/580,125 filed Nov. 1, 2017, and U.S. Provisional Application No. 62/630,573 filed Feb. 14, 2018; the entireties of which are incorporated herein by reference.

BACKGROUND OF THE INVENTION

The present invention generally relates to heat exchangers, and more particularly to shell and tube type heat exchangers suitable for the power generation or other industries.

Shell and tube type heat exchangers are used in the power generation and other industries to heat or cool various process fluids. For example, heat exchangers such as feedwater heaters are employed in Rankine power generation cycles in combination with steam turbine-generator sets to produce electric power. In such applications, the shell-side fluid (i.e. fluid flowing within the shell external to the tubes) is typically steam and the tube-side fluid (i.e. fluid flowing inside the tubes) is feedwater. Lower pressure steam exhausted from the turbine is condensed which forms the feedwater. Multiple feedwater heaters are generally employed in a Rankine cycle to sequentially and gradually increase the temperature feedwater using steam extracted from various extraction points in the steam turbine. The heated feedwater is returned to the steam generator where it is converted back to steam to complete the cycle. The heat source used to convert the feedwater to steam in the steam generator may be nuclear, fossil fuels, solar, biomass, or other sources.

Typical tubular heat exchanger types, shown in the TEMA (Tubular Exchanger Manufacturers Association) standards for example, usually employ either straight tubes or U-tubes. The tubes individually provide the pressure boundary for the tube-side fluid. Tube bundles comprising a multitude of such tubes are commonly enclosed in a straight shell which provides the pressure boundary for the shell-side fluid. The opposite ends of U-tubes in a U-tube bundle are supported by and fluidly sealed to a single tubesheet for support by suitable means to provide a fluid tight seal. The opposite ends of straight tubes in a straight tube bundle are supported by and fluidly sealed to a pair of spaced apart parallel tubesheets provided at opposite ends of the straight shell.

In certain operating conditions, high longitudinal stresses in the shell and the tube bundle arise from differential thermal expansion due to differences in the shell and tubing material's coefficients of thermal expansion and fluid temperatures between the two flow streams (tube-side and shell-side). In fixed tubesheet heat exchangers operating under severe service conditions at high temperatures (e.g. temperatures in excess of 500 degrees F.), the differential expansion induced stress is the greatest threat to the unit's integrity and reliability. Other design alternatives used in the industry, such as a straight shell with an in-line bellow type expansion joint, outside packed floating head, etc., suffer from demerits such as risk of leakage (packed head design) or reduced structural ruggedness (expansion joint design).

A need exists for an improved heat exchanger design which can compensate more effectively for differential thermal expansion and improve reliability.

SUMMARY OF THE INVENTION

A shell and tube heat exchangers suitable for feedwater heating and other process fluid heating applications according to the present disclosure can compensate for differential thermal in a manner which overcomes the foregoing differential thermal expansion problems with past fixed heat exchanger designs. A curved tube bundle heat exchanger design is provided which, for certain operating conditions, may be substantially superior with respect to reliability and thermal efficiency. The curved tube bundle may have generally J-shaped tubes configured as disclosed herein. The J-curved tube bundle serves to substantially eliminate the high longitudinal stresses in the shell and the tube bundle that arise from differential thermal expansion from the differences in the shell and tubing material's coefficients of thermal expansion and fluid temperatures between the two tube-side and shell-side flow streams. In fixed tubesheet heat exchangers operating at high temperatures, the differential expansion induced stress and cracking is the greatest threat to the unit's integrity.

Another operational benefit of the present heat exchanger design is the introduction of the shell side inlet flow into an open (un-tubed) space or plenum, which removes or minimizes the risk of impingement erosion damage common to tubular heat exchangers that have the shell inlet located in close proximity of the tubes. The present design prevents the shell-side flow from impinging directly on the tubes in a concentrated fluid stream (i.e., the flow is not delivered in the congested tubed space and orthogonal to the tubes' axis) by providing room within the shell for the shell-side flow to expand thereby resulting in a reduction in velocity and less erosive effects. This is significant because the shell-side fluid inlet nozzle is typically smaller in diameter than the shell itself.

In one configuration, the heat exchanger includes an integrated shell assembly comprising a longitudinal shell and a transverse shell arranged orthogonally (perpendicularly) or obliquely to the longitudinal shell. The longitudinal shell may be coupled between and inboard of opposing ends of the transverse shell, and may be approximately centered therebetween in some embodiments. The shells may sealably joined and fluidly coupled directly together into a basic T-shaped heat exchanger unit. A variety of other geometrically shaped heat exchanger units or assemblies may be formed by combining and fluidly interconnecting several basic T-shaped heat exchanger units to form a shared common shell-side pressure retention boundary. The J-shaped tube bundle can be readily accommodated in the foregoing shell geometries. The shells may be seal welded together in one construction. The shell-side spaces within each shell of the assembly are in fluid communication forming a contiguous shell-side space through which the tubes of the tube bundle are routed. It bears noting the present assembly of shells collectively form a single heat exchanger unit since each shell is not in itself a discrete or separate heat exchanger with its own dedicated tube bundle. The heat exchanger thus comprises a single tube-side inlet tubesheet and single tube-side outlet tubesheet located within different shells of the T-shaped shell configuration, as further described herein. In one embodiment, the tubesheets are oriented perpendicular to each other.

In one respect, a heat exchanger comprises: an elongated longitudinal shell defining a first shell-side space and a longitudinal axis; an elongated transverse shell defining a second shell-side space and a transverse axis; the transverse shell oriented transversely to the longitudinal shell; the second transverse shell fluidly coupled to a first end of the longitudinal shell such that the second shell-side space is in fluid communication with the first shell-side space; a tube bundle extending through the first and second shell-side spaces, the tube bundle comprising a plurality of tubes each having a first end coupled to a first tubesheet in the first shell-side space of the first longitudinal shell and a second end coupled to a second tubesheet in the second shell-side space of the second transverse shell; wherein the first and second tube-sheets are oriented non-parallel to each other. In one embodiment, the longitudinal shell is coupled to the transverse shell inwards of and between opposing ends of the transverse shell. In the same or another embodiment, the longitudinal shell is oriented perpendicularly to the transverse shell forming a T-shaped heat exchanger.

In another respect, a heat exchanger comprises: an inlet tubesheet and an outlet tubesheet; an elongated longitudinal shell assembly defining a first shell-side space and a longitudinal axis; the longitudinal shell assembly comprising opposing first and second ends, a circumferential sidewall extending between the first and second ends, a tube-side fluid inlet nozzle fluidly coupled to the inlet tubesheet, and a shell-side fluid outlet nozzle fluidly coupled to the circumference sidewall; an elongated transverse shell assembly fluidly coupled to the first end of the longitudinal shell, the transverse shell assembly defining a second shell-side space and a transverse axis oriented perpendicularly to the longitudinal axis of the longitudinal shell, the second shell-side space being in direct fluid communication with the first shell-side space; the transverse shell assembly comprising opposing first and second ends, a circumferential sidewall extending between the first and second ends, a tube-side fluid outlet nozzle fluidly coupled to the outlet tubesheet, and a shell-side fluid inlet nozzle; a J-shaped tube bundle extending through the first and second shell-side spaces between the inlet and outlet tubesheets, the tube bundle comprising a plurality of tubes each having a first end fluidly coupled to the inlet tubesheet in the first shell-side space of the longitudinal shell and a second end fluidly coupled to the outlet tubesheet in the second shell-side space of the transverse shell; a tube-side fluid flowing through the tube bundle and a shell-side fluid flowing through the longitudinal and transverse shell assemblies; wherein the first and second tube-sheets are oriented non-parallel to each other.

In another respect, a heat exchanger comprises: a longitudinally-extending first shell defining a first shell-side space and a first longitudinal axis; a longitudinally-extending second shell defining a second shell-side space and a second longitudinal axis, the second shell arranged parallel to the first shell; a transverse third shell fluidly coupling the first and second shells together, the third shell extending laterally between the first and second shells and defining a third shell-side space in fluid communication with the first and second shell-side spaces; first and second J-shaped tube bundles each comprising a plurality of tubes and each tube defining a tube-side space, the first tube bundle extending through the first and third shells, and the second tube bundle extending through the second and third shells; a first tube-side inlet nozzle disposed on the first shell; a second tube-side inlet nozzle disposed on to the second shell; and at least one shell-side inlet nozzle disposed on the transverse third shell; wherein a shell-side fluid flows in path from the third shell-side space through the first and second shell-side spaces to a shell-side outlet nozzle disposed on each of the first and second shells.

Any of the features or aspects of the invention disclosed herein may be used in various combinations with any of the other features or aspects. Accordingly, the invention is not limited to the combination of features or aspects disclosed herein as examples.

Further areas of applicability of the present invention will become apparent from the detailed description hereafter and drawings.

BRIEF DESCRIPTION OF THE DRAWINGS

The features of the exemplary embodiments will be described with reference to the following drawings where like elements are labeled similarly, and in which.

Figure 1:
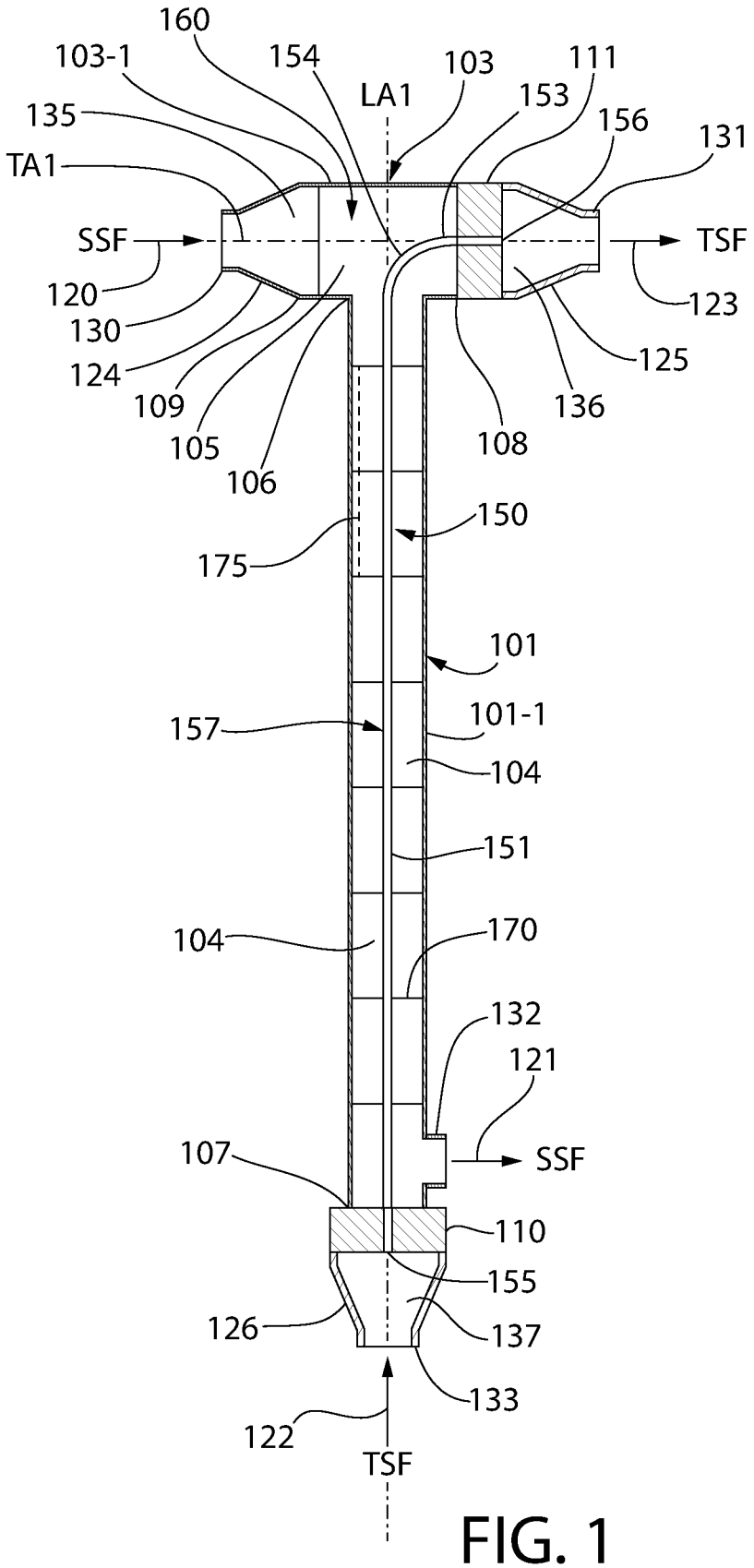
FIG. 1 is a cross-sectional view of a curved tube heat exchanger according to the present disclosure including a longitudinal shell and a transverse shell.

All drawings are schematic and not necessarily to scale. Parts shown and/or given a reference numerical designation in one figure may be considered to be the same parts where they appear in other figures without a numerical designation for brevity unless specifically labeled with a different part number and described herein.

DETAILED DESCRIPTION OF THE INVENTION

The features and benefits of the invention are illustrated and described herein by reference to exemplary embodiments. This description of exemplary embodiments is intended to be read in connection with the accompanying drawings, which are to be considered part of the entire written description. Accordingly, the disclosure expressly should not be limited to such exemplary embodiments illustrating some possible non-limiting combination of features that may exist alone or in other combinations of features.

In the description of embodiments disclosed herein, any reference to direction or orientation is merely intended for convenience of description and is not intended in any way to limit the scope of the present invention. Relative terms such as "lower," "upper," "horizontal," "vertical,", "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise.

Figure 2:
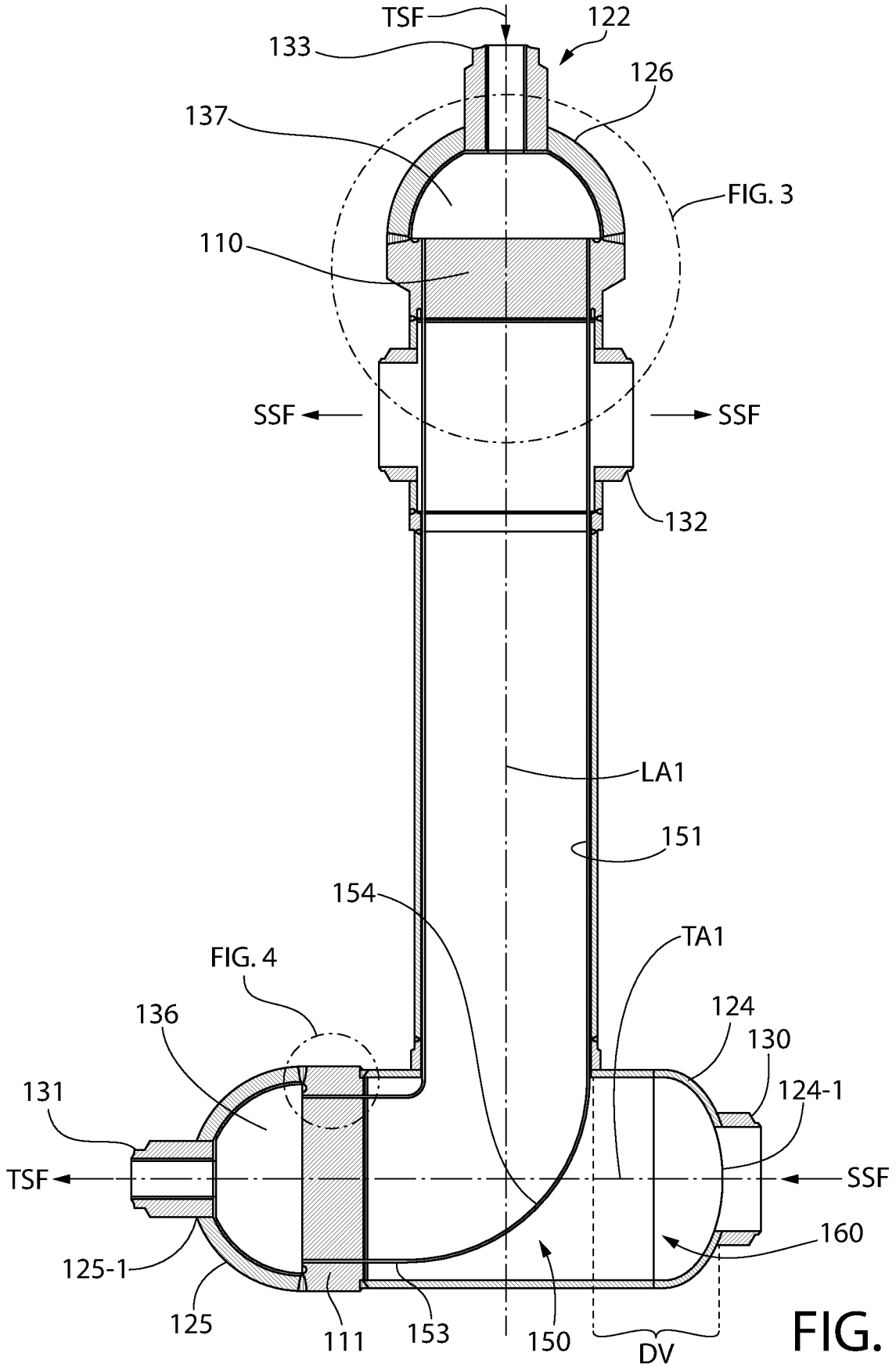
FIG. 2 is a cross-sectional view of the curved tube heat exchanger showing an alternative orientation.
Figure 3:
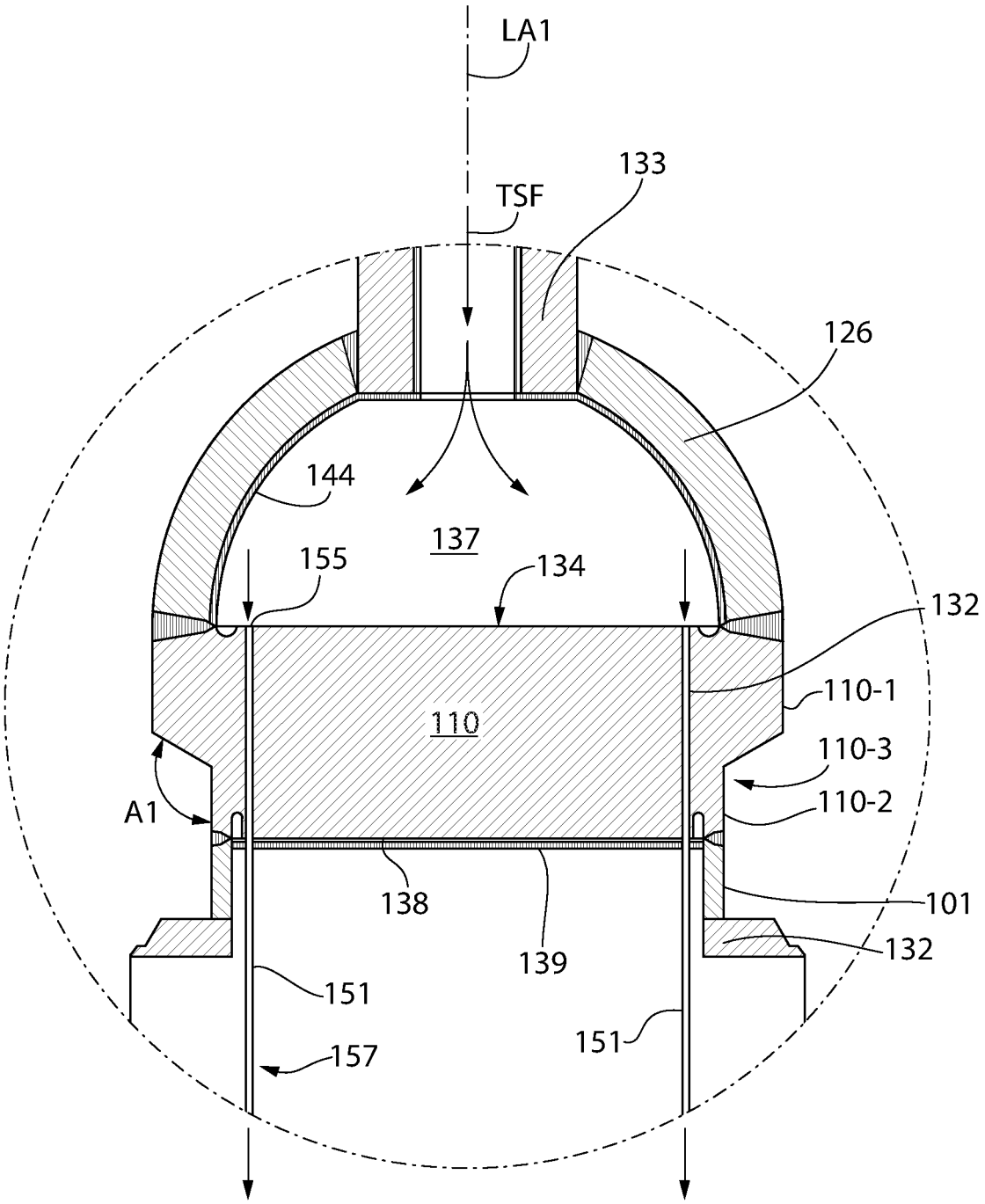
FIG. 3 is an enlarged detail from FIG. 2 showing the tube-side inlet head and tubesheet construction.
Figure 4:
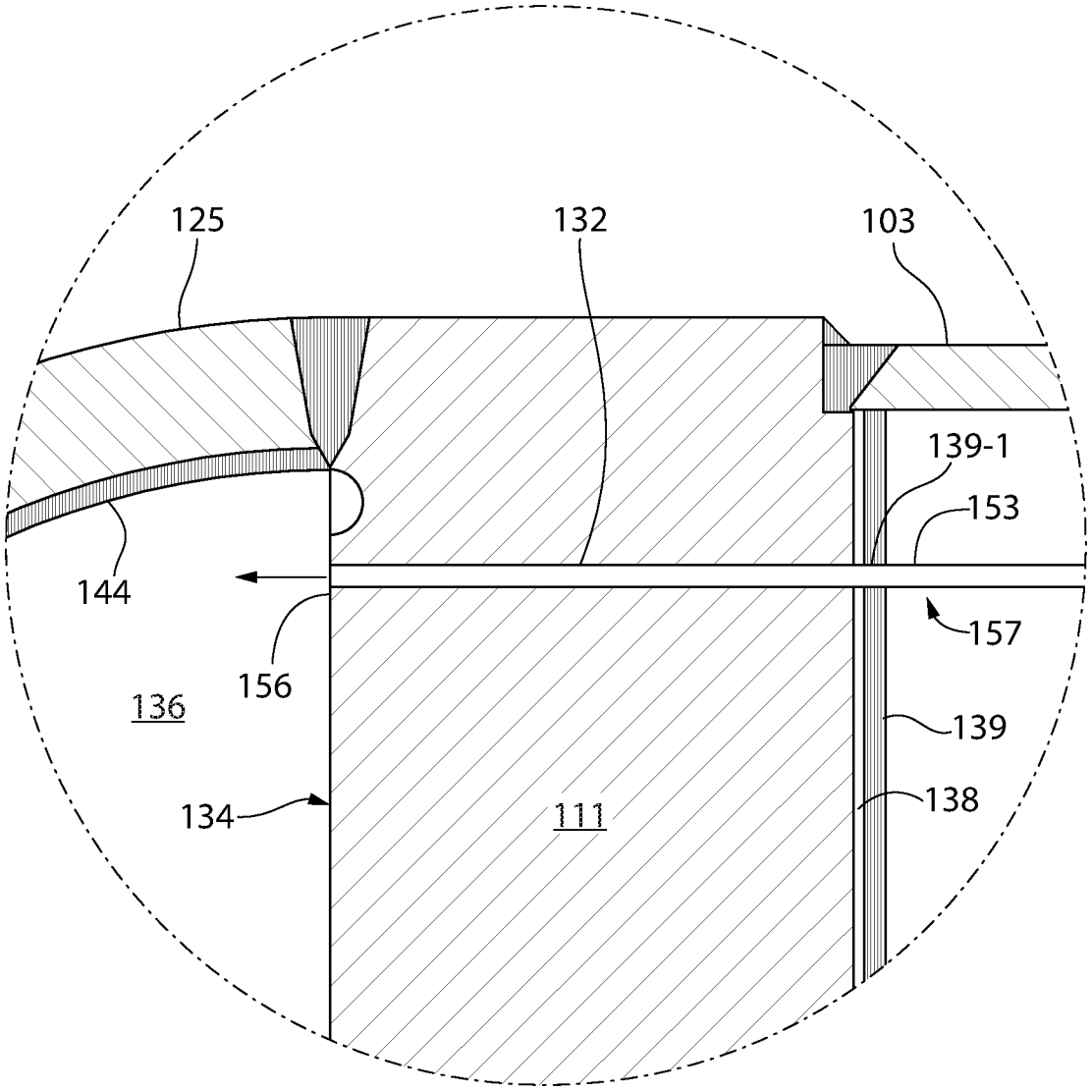
FIG. 4 is an enlarged detail from FIG. 2 showing a portion of tube-side outlet tubesheet construction.

FIGS. 1 and 2 depict one non-limiting embodiment of a shell and tube heat exchanger 100 according to the present disclosure. FIGS. 3 and 4 depict construction details of the heat exchanger. Heat exchanger 100 may be an ASME Boiler & Pressure Vessel Code (B&PVC) compliant construction.

Heat exchanger 100 includes an integrally formed shell assembly comprising an elongated longitudinal shell 101 defining a longitudinal axis LA1 and an elongated transverse shell 103 defining a transverse axis TA1. Longitudinal and transverse shells 101 and 103 are cylindrical in one embodiment each including axially straight and circumferentially-extending sidewalls 101-1 and 103-1 respectively. Longitudinal shell 101 includes terminal opposing ends 106, 107. Transverse shell 103 includes terminal first and second ends 108, 109. The longitudinal and transverse shells may have the same or different diameters. The longitudinal shell and transverse shell define respective internal open shell-side spaces 104 and 105 for receiving, circulating, and discharging a shell-side fluid SSF. The shell-side spaces 104 and 105 are in fluid communication such that each shell-side space fully opens into the adjoining shell-side space to form a singular and contiguous common shell-side space for housing a tube bundle.

It bears noting that although the longitudinal and transverse shells 101 and 103 are depicted as vertically and horizontally oriented respectively for convenience of reference only, the heat exchanger 100 may be used in any suitable orientation since both the tube-side and shell-side fluids are generally pressurized. Furthermore, it is apparent by comparing FIGS. 1 and 2 that the transverse shell 103 may be arranged at the top or bottom of the shell assembly, or on either side in other embodiment in which the longitudinal shell 101 may be horizontally oriented and the transverse shell vertically oriented instead. Any orientation or location of either shells 101, 103 may be used to suit the particular installation needs and available site space for the heat exchanger particularly in heat exchanger retrofit applications.

Each of the longitudinal and transverse shell 101, 103 is linearly elongated and straight having a substantially greater length than diameter. Longitudinal shell 101 may be longer than transverse shell 103 in length. In some embodiments, longitudinal shell 101 may have a length greater than two times or more the length of the transverse shell 103 (see, e.g. FIG. 1).

In the present configuration, the longitudinal and transverse shells 101, 103 are collectively arranged to form an integrated T-shaped shell assembly. Terminal end 106 of longitudinal shell 101 is fluidly and sealably joined or coupled directly to the transverse shell 103 between ends 108, 109 of the transverse shell without any intermediary piping or structures. In one implementation, the longitudinal shell is coupled to transverse shell 103 approximately midway between its ends 108, 109 as shown. In other possible embodiments, the longitudinal shell 101 may be offset from the midpoint of the transverse shell 103. The opposite second terminal end 107 of the longitudinal shell 101 is sealably joined directly to a first inlet tubesheet 110 (see, e.g. FIG. 3), which is oriented transversely across the end and to the longitudinal axis LA1. Longitudinal shell 101 may be seal welded via circumferential welds to both the transverse shell 103 and first tubesheet 110 in one construction to form a sealed leak-proof fluid connection and pressure retention boundary.

The shell-side fluid outlet 121 and a tube-side fluid TSF inlet 122 may be disposed on longitudinal shell 101. The shell-side fluid outlet 121 may comprise one or more outlet nozzles 132 which may be welded to or formed integrally with the longitudinal shell as a unitary structural part thereof. In one embodiment, the outlet nozzle(s) is/are radially oriented and located proximate to the first tubesheet 110 as shown to maximize the distance and heat between the shell-side fluid inlet and outlet of the heat exchanger 100 for optimizing heat transfer to the tube-side fluid.

The tube-side fluid inlet 122 may comprise a welded assembly including tube-side inlet channel or head 126 seal welded to tubesheet 110, and a tube-side fluid inlet nozzle 133 seal welded to the head as shown. The cavity within head 126 defines a tube-side inlet plenum 137.

The shell-side fluid inlet 120 and a tube-side fluid TSF outlet 123 may be disposed on transverse shell 103. The shell-side fluid inlet 120 may comprise a welded assembly including shell-side inlet channel or head 124 seal welded to second end 109 of transverse shell 103, and a shell-side inlet nozzle 130 seal welded to the head as shown. Head 124 defines a shell-side inlet plenum 135.

The second terminal end 108 of the transverse shell 103 is sealably joined or coupled directly to a second outlet tubesheet 111 oriented transversely across the end and to the transverse axis TA1 of the shell. The tube-side fluid outlet 123 may comprise a welded assembly including tube-side outlet channel or head 125 seal welded to tubesheet 111, and a tube-side fluid outlet nozzle 131 seal welded to the head as shown. Head 125 defines a tube-side outlet plenum 136.

The first tubesheet 110 in longitudinal shell 101 and second tubesheet 111 in transverse shell 103 may be oriented perpendicularly to each other as shown. In other configurations where the transverse shell may be oriented obliquely to the longitudinal shell, the tubesheets 110, 111 may be oriented at an oblique angle to each other.

In one embodiment, the tube-side fluid nozzles 131, 133, and shell-side fluid nozzle 130 preferably may be centered on their respective heads 125, 126, and 124. The nozzles 131 and 130 are thus coaxial with the transverse axis TA1 of the transverse shell 103. Nozzle 133 preferably may be coaxial with the longitudinal axis LA1 of longitudinal shell 101. The coaxial introduction or extraction of flow to/from the heat exchanger 100 contributes to less turbulent flow regimes within the heat exchanger. In other possible embodiments, however, the nozzles 130, 131, and 133 may be non-coaxially oriented with their respective axes such as obliquely angled or perpendicularly/radially oriented to their respective axes. These later arrangements may be necessary depending on available space within the power generation or other industrial facility and existing/new piping runs to/from the heat exchanger.

Any suitable type and shape of heat exchanger channel or head used in the art may be used for heads 124-126. The heads may be ASME Boiler & Pressure Vessel Code (B&PVC) compliant heads. Examples of commonly used heat exchanger head types include without limitation a bonnet (dished or frustoconical as shown), straight, hemispherical ("hemi heads"), semi-elliptical, or flanged and dished heads as some non-limiting examples. The type/shape of the heads do not limit the invention in any way. In some embodiments, the heads 125 and 126 may be bolted via flanges to their respective tubesheets 111, 110 where frequent access to inspect and non-destructively examine the tubesheets is required. In some embodiments, a removable cover plate may be used with a straight channel/head welded to the tubesheet instead to facilitate inspection. Accordingly, numerous variations in design are possible to suit particular needs and installation circumstances.

Heat exchanger 100 can advantageously be mounted in any suitable orientation in an available three-dimensional space in the power generation or other industrial facility to best accord with the plant's architectural and mechanical needs (piping runs, support foundation locations, vent & drain lines, etc.). Accordingly, the heat exchanger shown in FIGS. 1 and 2 may be mounted vertically, horizontally, or at any angle therebetween. Although the shell-side outlet nozzle(s) are illustrated as coplanar with the transverse shell 103, in other embodiments the outlet nozzles can be rotated and positioned at any other angled position obliquely to the transverse axis TA1 of the transverse shell to accommodate piping runs to and from the heat exchanger without loss in performance efficacy and efficiency.

The shells 101, 103 of heat exchanger 100 may be formed of any suitable metal used in the art for heat exchanger shells. In one example, the shells may be formed of steel such as stainless steel for corrosion protection. Other suitable metal including various steel or other alloys may of course be used depending on the service conditions encountered (e.g. type of fluid, pressure, and temperature), which may in part dictate the choice of material along with cost.

The direction of flow of the shell-side and tube-side fluids within the heat exchanger may be countercurrent or co-current. In FIGS. 1 and 2, the tube-side and shell-side fluid flows are in a countercurrent arrangement (i.e. flowing in opposite directions) thereby providing thermally efficient countercurrent flow arrangement with protection of the tube bundle from potentially deleterious effects of impingement from the incoming shellside flow via auxiliary plenum 160 previously described herein. However, if tube damage from shell flow impingement is not a concern, then it may be possible to switch shell-side fluid and tube-side fluid inlets and outlets on both shell and tube sides preserving countercurrency. In some rather infrequent cases, it is desired to have a co-current flow arrangement which can be readily realized by switching either the shellside or the tubeside inlet/outlet nozzles as required. Accordingly, the present heat exchanger is not limited to either countercurrent or co-current flow arrangements.

Although heat exchanger 100 has been discussed and illustrated by a single tube-side tube-pass configuration, in certain applications multiple tubeside pass (multi-pass) arrangements may be employed without difficulty in manners well known in the art. Extension of this design to multi-tube pass can be readily carried out by providing multi-pass bonnets or heads in a similar manner to what is done in straight tube heat exchangers. Thus, for example, for a two-tube pass arrangement, the inlet bonnet or head 126 on the longitudinal shell 101 would be divided into two separate internal chambers, and both inlet and outlet tube-side nozzle connections will be located within the inlet head 126 while the head 125 on the transverse shell 103 serves merely as the return header. For example, heat exchanger head 125 (previously associated with tube-side outlet 123) may be replaced by a fully closed head (i.e. no tube-side fluid outlet nozzle 131). A pass partition plate (not shown) may be mounted within the inlet tube-side flow plenum 137 of inlet head 126 to divide the plenum evenly into an inlet side and an outlet side of the flow plenum. The single inlet nozzle 133 may be replaced by a new tube-side fluid inlet nozzle communicating with the inlet side of the plenum 137 and adding a new separate tube-side fluid outlet nozzle communicating with the outlet side of the plenum. Such nozzles may be radially oriented (i.e. transversely to longitudinal axis LA1) if a straight head design is used, or obliquely to longitudinal axis LA1 if a curved or hemispherical head design is used. These nozzle and partition plate arrangements are well known in the art and commonly used without undue elaboration herein. Accordingly, the T-shaped heat exchanger 100 may be reconfigured in a multitude of ways to fit the particular needs of virtually any application.

In one embodiment, the shell-side fluid may be steam and the tube-side fluid may be feedwater of a Rankine cycle used in a power plant for producing electricity. Other states of fluids and/or types of fluids such as petroleum or chemicals may be processed using heat exchanger 100. For example, both the shell-side and tube-side fluids may be liquid in some applications. Heat exchanger 100 is therefore not limited in the breadth of its applicability and use in an industrial process for heating fluids.

The longitudinal and transverse shells 101, 103 may be thought of as forming shell assemblies when fully constructed and assembled together including the heads, tubesheets, and nozzles. For example, a longitudinal shell 101 assembly comprises the opposing ends 106 and 107, circumferential sidewall 101-1 extending between the ends, tube-side fluid inlet nozzle 133 fluidly coupled to the inlet tubesheet 110, and a shell-side fluid outlet nozzle 132 fluidly coupled to the circumferential sidewall. The transverse shell 103 assembly comprises opposing ends 108 and 109, a circumferential sidewall 103-1 extending between the ends, tube-side fluid outlet nozzle 131 fluidly coupled to the outlet tubesheet 111, and a shell-side fluid inlet nozzle 130.

Figure 5:
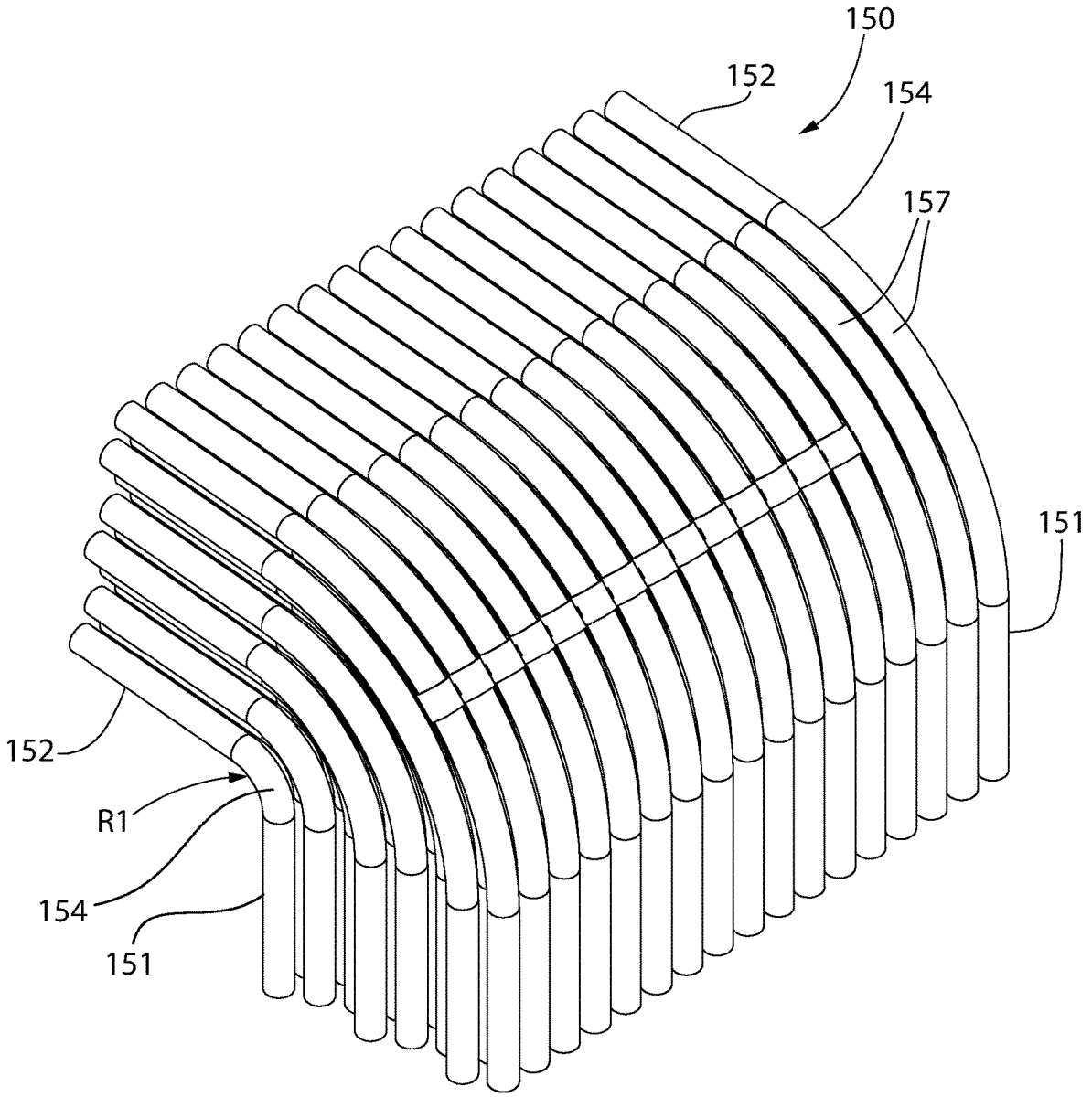
FIG. 5 is a perspective view of the tube bend portion of the J-shaped tube bundle of FIGS. 1 and 2.

With additional reference to FIG. 5 showing the bend area of the tubes, a generally "J-shaped" tube bundle 150 is disposed in the longitudinal and transverse shells 101, 103. The tube bundle 150 comprises a plurality of relatively closely spaced J-shaped tubes 157 which extend contiguously from tube-side inlet tubesheet 110 of longitudinal shell 101 through the shell-side spaces 104 and 105 to tube-side outlet tubesheet 111 of transverse shell 103. FIGS. 1 and 2 depict only a single or a few tubes 157 for brevity, recognizing that the tube bundle 150 comprises multiple tubes of similar shape arranged in parallel to each other to form a tightly packed tube bundle. Tubes 157 are cylindrical with a circular or round cross section. Tubes 157 each include a long leg 151 disposed in longitudinal shell 101 and a short leg 153 disposed in transverse shell 103. The long and short legs 151, 153 are fluidly coupled together by 90-degree arcuately curved and radiused tube bends 154 such that the short leg 153 is perpendicular to the long leg 151. The tube bends 154 may have a minimum centerline bend radius R1 equal to or greater than 2.5 times the tube diameter as an example. Other suitable radiuses may be used. It bears noting that tube legs 151, 153 and bends 154 form a continuous and contiguous tube structure and tube-side space from the inlet of the tubes 157 fluidly coupled to tubesheet 110 to the outlet of the tubes fluidly coupled to outlet tubesheet 111.

Tubes 157 each include a first inlet end 155 defined by long leg 151 which extends through tubesheet 110 to inlet plenum 137 and a second outlet end 156 defined by short leg 153 which extends through tubesheet 111 to plenum 136 (see also FIGS. 1-4). Tubesheets 110, 111 each include a plurality of axially extending and parallel through bores 132 oriented parallel to longitudinal axis LA1 of longitudinal shell 101. Terminal end portions of tubes 157 are received in and extend completely through and inside through bores 132 to the outboard surface or face 134 of each tubesheet 110, 111 (an example of one face 134 of tubesheet 110 being shown in FIG. 3—the other tubesheet 111 having the same arrangement). The open ends 155 of tubes 157 in tubesheet 110 receive the tube-side fluid from inlet nozzle 133 and plenum 137. Conversely, the other open ends 156 of tubes 157 in tubesheet 111 discharge the tube-side fluid into plenum 136 and through outlet nozzle 131. The tubesheets 110, 111 support the terminal end portions of the tubes in a rigid manner.

The tubes 157 are fixedly coupled to tubesheets 110, 111 in a permanently sealed leak-proof manner to prevent leakage from the generally higher pressure tube-side fluid TSF to the lower pressure shell-side fluid SSF. The pressure differential between shell side and tube side may be extremely great for some high pressure heaters creating higher exposure for tube-to-tubesheet joint leaks. For example, tube-side design pressures can range from about 300 psig to over 5000 psig for high pressure feedwater heaters, while the shell-side design pressures can range from about 50 psig to 1500 psig for higher pressure heaters. In some embodiments, the tubes 157 may rigidly coupled to the tubesheets 130, 131 via expansion or expansion and welding; these techniques being well known in the art without further elaboration required. Commonly employed tube expansion processes that may be used include explosive, roller, and hydraulic expansion.

The tubes 157 may be formed of a suitable high-strength metal selected for considerations such as for example the service temperature and pressure, tube-side and shell-side fluids, heat transfer requirements, heat exchanger size considerations, etc. In some non-limiting examples, the tubes may be formed of stainless steel, Inconel, nickel alloy, or other metals typically used for power generation heat exchangers which generally excludes copper which lacks the mechanical strength for such applications.

Advantageously, the J-shaped curved tubes 157 of tube bundle 150 serve to substantially eliminate the high longitudinal stresses in the shell and the tube bundle that arise from differential thermal expansion from the differences in the shell & tubing material's coefficients of thermal expansion and fluid temperatures between the two flow streams (tube-side and shell-side). In fixed tubesheet heat exchangers operating at high temperatures, the differential expansion induced stress is the greatest threat to the unit's integrity. Another operational benefit is the introduction of the shell side inlet flow into an open (un-tubed) space within the shell which removes or mitigates the risk of impingement damage common to tubular heat exchangers that have the shell inlet located in close proximity to the tubes. This present design prevents the shellside flow from impinging directly on the tubes (i.e., the flow is not delivered in the congested tubed space within the shell thus precluding or minimizing impingement or erosion damage to the tubes).

The inlet and outlet tubesheets 110, 111 have a circular disk-like structure and an axial thickness suitable to withstand cyclical thermal stresses and provide proper support for the tubes 157. The tubesheets may each have a thickness substantially greater than the thickness of their respective shells 101, 130 (e.g. 5 times or greater) as illustrated in the figures. Tubesheets 110, 111 each include a outboard surface or face 134 and inboard surface or face 138. The tubesheets 110, 111 may be formed of a suitable metal, such as steel including alloys thereof. The tubesheets may be formed of stainless steel in one embodiment.

The outer rim of tubesheets 110, 111 is preferably made as thin (radially) as possible within the limitations of the machining equipment so that the differential thermal expansion in the radial direction due to the temperature difference between the perforated region of the tubesheets containing through bores 132 and the solid outer peripheral rim does not produce high interface stresses. The outer peripheral rim may be machined, as practicable, to reduce the rim thickness. Typically, the rim can be made as little as ¼-inch thick in some instances (measured from the outermost tube bore).

Referring to FIGS. 1-4, the tube-side flow path originates with tube-side inlet nozzle 133 fluidly coupled to inlet tubesheet 110 via inlet plenum 137 for introducing the tube-side fluid TSF into the portion of the tube bundle 150 disposed in longitudinal shell 101 (also associated with the outlet of the shell-side fluid from heat exchanger 100). The tube-side fluid enters inlet plenum 137 from inlet nozzle 133 and flows into the tubes 157 in tubesheet 110 and through the tube bundle 150 to outlet tubesheet 111 disposed on transverse shell 103 (also including the inlet 120 of the shell-side fluid into the heat exchanger 100). Tube-side outlet nozzle 131 is fluidly coupled to outlet tubesheet 111 via outlet plenum 136 for discharging the tube-side fluid from the heat exchanger. It bears noting that with the J-shaped tube bundle 150, the tube-side fluid is discharged from heat exchanger 100 in a direction which is 90 degrees to the inlet of the tube-side fluid.

The shell-side fluid shell-side fluid flow path originates with shell-side inlet nozzle 130 of transverse shell 103. In a preferred embodiment, the internal shell-side cavity or space 105 within transverse shell 103 receives the shell-side fluid from the shell inlet nozzle 130 in an open un-tubed volume or space (e.g. referred to as auxiliary plenum 160 herein) in the transverse shell (see, e.g. FIGS. 1 and 2). The auxiliary plenum 160 is a cumulative volume collectively defined by volumes in the tubeless end portion of the internal shell-side space 105 of transverse shell 103 at the shell-side inlet 120 and by the inlet head 124. The operational benefit is that auxiliary plenum 160 provides a distance and void in the transverse shell 103 for introduction of the shell side inlet flow in a manner which removes or mitigates the risk of impingement erosive damage to the tubes 157 which is a common problem in shell and tube heat exchangers having the shell-side fluid inlet located in close proximity or directly into the tubes. This present design prevents the shell-side fluid flow from impinging directly on the tubes while at its highest velocity directly from the shell-side fluid inlet nozzle 130 by providing extra volume in auxiliary plenum 160 of the transverse shell 103 which is free of tubes. The extra volume provided by the shell-side auxiliary plenum 160 allows the shell-side fluid to expand, thereby reducing its velocity to ameliorate the erosive effects of the fluid stream. In other words, the second plenum 160 provides that the shell-side fluid stream or flow is not delivered in the congested tubed space within the transverse shell thus precluding or minimizing impingement and erosive damage to the tube bends). The auxiliary plenum 160 may be adjusted by increasing/decreasing the axial length of the transverse shell 103 and concomitantly the plenum therein to provide the necessary protection for the tube bundle 150 from erosion by the shell-side fluid.

In one embodiment, the shell-side fluid auxiliary flow plenum 160 in transverse shell 103 has an axial length DV measured along transverse axis TA1 which extends horizontally from the terminal end 124-1 of the shell-side fluid inlet head 124 to the nearest point on shell 103 where the longitudinal shell 101 is attached (as identified in FIG. 2). In one embodiment, DV is at least ¼ the axial length of the transverse shell 103 measured between the terminal ends 124-1, 125-1 of its opposing heads 124, 125 respectively to provide space for expanding the inlet shell-side fluid.

The shell-side fluid flow is introduced in a flow direction axially aligned and parallel to transverse axis TA1 and short sections 153 of tubes 157. The shell-side fluid is thus introduced to flow in an axially straight direction in line with and directly towards the outlet tubesheet 111 as shown in FIGS. 1 and 2. The shell-side fluid flow is directed towards and encounters the tube bends 154 of tube bundle 150 before changing direction 90 degrees and flowing through the longitudinal shell 101 in a flow direction axially aligned and parallel to longitudinal axis LA1. The tube bends 154 are thus subjected to shell-side fluid at its highest temperature from shell-side inlet 120 thus providing final heating and increase in temperature of the tube-side fluid immediately before exiting the tubes 157 from the tubesheet 111 into the tube-side fluid outlet flow plenum 136.

With continuing reference to FIGS. 1 and 2, the shell-side fluid SSF enters the auxiliary plenum 160 of transverse shell 103 from the shell-side inlet nozzle 130 at the shell-side inlet 120. The shell-side fluid changes direction and flows 90 degrees through the longitudinal shell 101 to the outlet nozzle(s) 132 where the shell-side fluid leaves the heat exchanger 100 in a radial direction oriented parallel to the inlet direction of the fluid into the heat exchanger. In one embodiment, the shell-side fluid may leave the heat exchanger in the same direction as the shell-side fluid inlet flow (albeit spaced apart and not in the same horizontal plane).

Tube-side nozzles 133 and 131 may be seal welded to their respective heads 126, 125 to form a leak proof fluid connection. Heads 126, 125 are in turn seal joined via welded connections or flanged bolted connections to their respective tubesheets 110, 111. Shell-side nozzles 130 and 132 are similarly seal welded to head 124 and the circumferential wall of shell 101 respectively. Nozzles 130, 131, 132, and 133 are each provided with terminal ends configured for fluid connection to external piping such as via welding, flanged and bolted joints, or other types of mechanical fluid couplings. In one embodiment, each of the nozzles 130-133 may be provided with weld end preparations for connection to external piping. Nozzles 130-133 are relatively short fluid coupling structure generally having a length less than a diameter of their respective shells 101 or 103 to which they are attached or integrally formed therewith. Nozzles 130-133 may be made of any suitable metal such as steel and alloys thereof as some non-limiting examples.

Referring to FIGS. 1 and 6A-6C, heat exchanger 100 further includes a plurality of baffles 170 arranged transversely inside the longitudinal shell 101 to support the tube bundle 150 and maintain lateral spacing between the tubes 157. Each baffle is formed of a suitable flat metal plate which includes a plurality holes to allow the tubes to pass through the baffles. Portions of the baffle plates where tubes are not present may of course be solid. The baffles may be supported by longitudinally-extending tie rods 175 coupled between the baffles for added stability against the shell-side fluid flow (schematic example of which is shown in FIG. 1 represented by dashed lines). The tie rods 175 maintain the longitudinal spacing between the baffles 170.

Figure 6B:
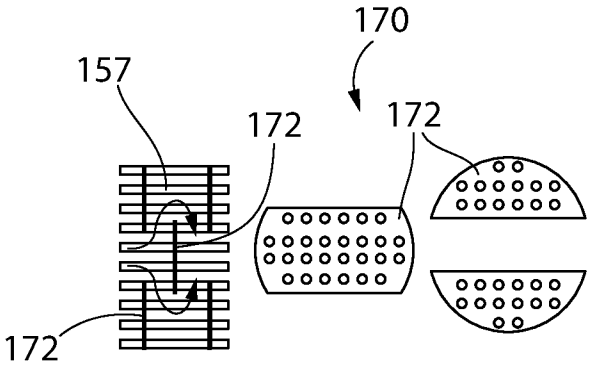
FIG. 6B shows a second embodiment of shell-side flow baffles.
Figure 6A:
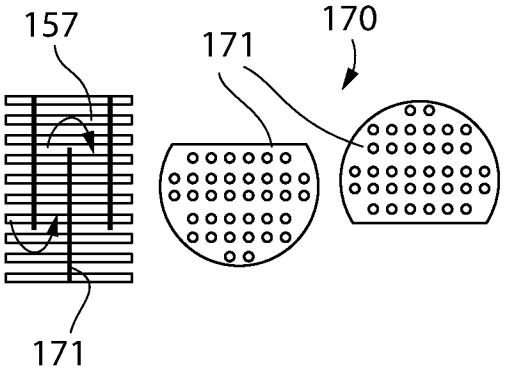
FIG. 6A shows a first embodiment of shell-side flow baffles.
Figure 6C:
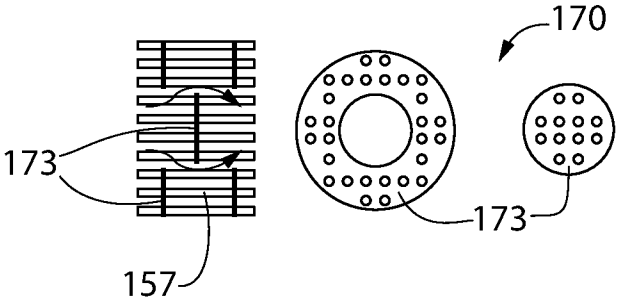
FIG. 6C shows a third embodiment of shell-side flow baffles.

The baffles 170 force the shell-side fluid to change direction and flow transversely across the tubes while increasing velocity to improve heat transfer performance and efficiency. FIGS. 6A-C show the typical shell-side fluid flow represented by directional flow arrows that is produced by some of the example baffles shown. Any type or combination of different types of baffles 170 may be used. Examples of commonly used baffles 170 well known in the art include single segmental baffles 171 (FIG. 6A), double segmental baffles 172 (FIG. 6B), triple segmental baffles (not shown), disc and donut baffles (FIG. 6C), etc. Where minimization of the shell side pressure loss is an important consideration, non-segmental baffles (not shown) may be utilized to maintain the shell-side fluid flow in an essentially axial direction. Such baffles, well known in the art without undue elaboration, generally comprise an open latticed structure formed by a plurality diagonally intersecting straps or plates forming diamond shaped openings as shown. The heat exchanger tubes pass through the openings. Regardless of the type(s) of baffles used, the number and longitudinal spacing between the baffles may be selected to insure freedom from and minimize of flow induced destructive tube vibrations which can lead to tube ruptures.

In some embodiments as shown in FIG. 1, baffles 170 may be omitted from the transverse shell 103 due to the relatively short length of the shell in contrast to the longer longitudinal shell 101. As shown, there are no straight sections of tubing 157 within the transverse shell 103 other than the end portions of the tubes which extend through the outlet tubesheet 111. In other embodiments where the transverse shell 103 may have greater lengths, baffles may be added as necessary to reduce shell-side fluid flow induced vibrations in the tubes. In yet other possible embodiments regardless of the length of the transverse shell 103, the curved tube bends 154 may be supported by an appropriately configured baffle 170.

In order to further protect the tubesheets 110, 111 from erosion caused by the flow of shell-side fluid, the inboard surface or face 138 may be protected by a flow blocker plate 139. Referring to FIGS. 2-4, the flow blocker plates 139 are substantially flat or planar and rigidly-sealably coupled to the longitudinal and transverse shells 101, 103 such as via circumferential welds. The block plates 139 are circular and have a diameter coextensive with the diameter of the tubesheets 110, 111 at their inboard faces 138 (which may be less than the outside diameters of the tubesheets) within the shell-side spaces 104, 105. Blocker plates 139 are oriented parallel to the tubesheet inboard faces 138 and preferably may be spaced apart as shown forming discrete structures separate from the tubesheets 110, 111. Each plate 139 includes a multitude of circular through holes 139-1 through which the tubes 157 may pass to the tubesheets. The blocker plates 139 are not connected in any way to the tubesheets in preferred embodiments.

In heat exchangers subject to thermal transients, special attention preferably should be given to the bonnet or channel (e.g. head) to tubesheet/shell joint where the parts may be at significantly different temperatures. The differential temperature problem may be most prevalent at the tubesheet/shell joint at the tube-side fluid inlet 122 end of the longitudinal shell 101. A joint design detail that minimizes the thickness of the tubesheet's rim (peripheral un-tubed region) and provides for radial flexibility to accommodate differential radial expansion may therefore be necessary. FIG. 3 shows such an exemplary detail. The tubesheet 110 may include a first portion 110-1 welded to head 126 having a first diameter and a second portion 110-2 welded to longitudinal shell 101 having a second diameter smaller than the first diameter. An annular stepped transition portion 110-3 is formed between portions 110-1 and 110-2 which extends circumferentially around the outer surface of the tubesheet 110. Transition portion 110-3 may be angled in one embodiment as shown to minimize the stress concentration factor in the tubesheet base material at the transition (as opposed to a 90-degree transition). An oblique transition angle A1 is formed between the larger and smaller diameter portions 110-1 and 110-2 for such an angled transition portion 110-3. Angle A1 is between 90 and 180 degrees, preferably between 110 and 170 degrees, and more preferably between 120 and 160 degrees. In one non-limiting example, angle A1 may be about 120 degrees.

In those applications where the heat exchanging streams undergo a significant temperature change, the two tubesheets 110, 111 may be at significantly different temperatures. In such cases, it may be commercially advantageous to utilize two different tubesheet materials. In some embodiments, a thermal liner 144 may also be employed in the tubesheet-related heads 125, 126 to alleviate the effect of transients in the tubeside fluid (see, e.g. FIGS. 3 and 4). The liner 144 may be configured for and in conformal contact with the interior surface of the heads 125, 126 thereby conforming to the shape of head interior surface. The liners 144 may be formed of the same or a different material than the heads. The liners may be formed of metal in one embodiment. Any suitable method of applying or attaching the liners to the heads may be used. In some embodiments, the liners 144 may be a metallic coating conformably applied to the interior surface of the heads 125, 126.

It also bears noting the use of flow blocker plates 139 previously described herein, which are spaced apart from the inboard faces 138 of the tubesheets 110, 111, creates a stagnant flow space or area at the shell/tube-sheet interface region that may also help mitigate the effect of thermal transients in addition to protecting the tubesheets from shell-side flow erosion.

According to another aspect of the invention, a plurality of the basic T-shaped heat exchanger 100 may be combined and closely coupled together physically and fluidly in a variety of different ways to produce a compound heat exchanger unit comprising an assembly of multiple heat exchanger 100 to suit particular application needs. The T-shaped heat exchangers 100, which forms the basic building block for constructing multi-unit heat exchanger systems or assemblies, is particularly amenable to such use.

Figure 7:
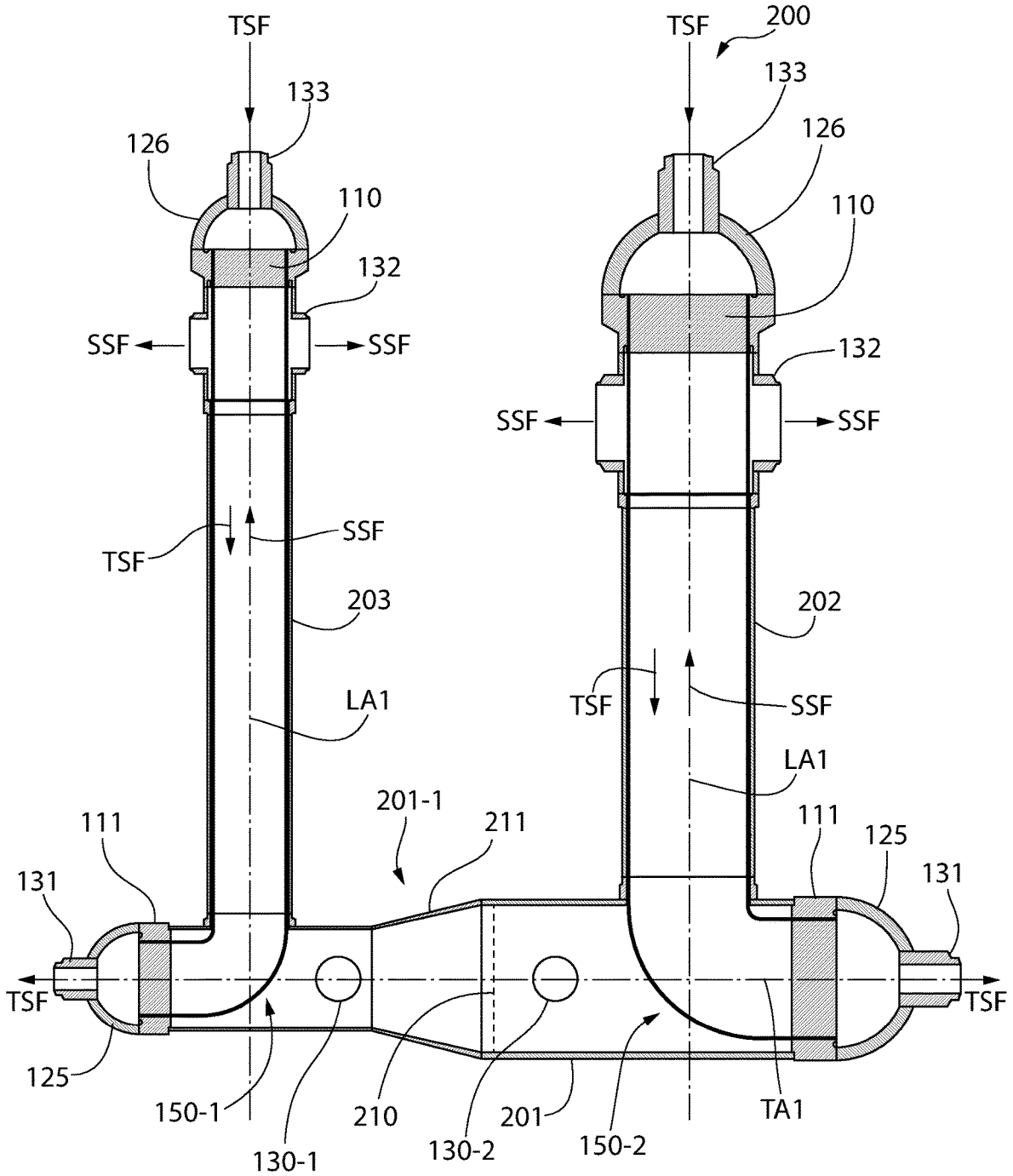
FIG. 7 shows a heat exchanger unit combining two heat exchangers of FIG. 2 sharing a common transverse shell.

One example of a double/dual heat exchanger unit 200 is shown in FIG. 7. In this embodiment, the transverse shells of the two heat exchangers 100 are combined into an elongated single common transverse shell 201. Transverse shell 201 may be horizontally oriented as shown in this non-limiting orientation (recognizing that heat exchanger unit 200 and transverse shell 201 can have any orientation such as vertical or angles between horizontal and vertical similarly to transverse shell 103). Heat exchanger unit 200 includes two vertically oriented longitudinal shells 202, 203 structured similarly to and having the same appurtenances as longitudinal shell 101 (e.g. tubesheets, heads, liners, nozzles, etc.). Longitudinal shells 202, 203 may be the same or different lengths/heights. Transverse shell 201 is structured similarly to and has the same appurtenances as two combined transverse shells 103 with an opposing pair of axially aligned tubesheets 111 (one at each end of the shell 201). Additional reference is made back to FIGS. 1 and 2 and previous description herein for details of the heat exchanger basic unit and construction.

Longitudinal shells 202 and 203 of heat exchanger unit 200 are horizontally/laterally spaced apart forming an intermediate section 201-1 in transverse shell 201 therebetween. Heat exchanger unit 200 has a generally U-shaped structure. The two upright longitudinal shells 202, 203 may have an orientation such as vertical (shown), horizontal in the same plane as transverse shell 201, or rotated to any angle between vertical and horizontal. The transverse shell 201 may similarly have any of the foregoing orientations, which will then dictate the orientation of the longitudinal shells 202, 203 coupled thereto. The entire heat exchanger 200 therefore may have any suitable orientation.

In one embodiment, a pair of shell-side fluid inlet nozzles 130-1, 130-2 are provided in intermediate section 201-1 which introduce the shell-side fluid (SSF) flow into the transverse shell 201 between the pair of tube-side outlet tubesheets 150. One inlet nozzle 130-1 may be proximate to J-shaped tube bundle 150-1 and the other nozzle 130-2 may be proximate to the other J-shaped tube bundle 150-2. The two separate shell-side fluid inlet flows may mix and combine within the transverse shell 201 to a certain degree because the transverse shell 201 is in fluid communication with each of the longitudinal shells 202, 203. However, basic flow dynamics provides that there will be a flow bias which directs the shell-side fluid to flow more preferentially towards the longitudinal shell which is nearest to each shell-side fluid inlet nozzle.

The foregoing dual shell-side fluid inlet nozzles 130-1, 130-2 allows shell-side fluid to be introduced into the heat exchanger unit 200 from two different sources (e.g. different steam extraction stages with different temperatures/pressures from a steam turbine of a Rankine cycle power generation plant). The dual SSF flows may mix and equalize in pressure and temperature within the transverse shell 201. In other embodiments, a flow partition plate 210 (shown in dashed lines in FIG. 7) may be provided which divides the intermediate section 201-1 of transverse shell 201 into two separate shell-side spaces to keep the shell-side fluid inlet flow fluidly isolated from one another. Alternatively, a shell-side fluid from a single common source may simply be bifurcated in piping upstream of the heat exchanger unit 200 and supplied to each inlet nozzle to better distribute the SSF flow in the transverse shell 201. In yet other embodiments, a single shell-side fluid inlet nozzle may be provided which is fluidly coupled to intermediate section 201-1 of transverse shell 201 without any internal partition plate to supply shell-side fluid flow to each longitudinal shell 202 and 203. Numerous options are therefore possible for introducing and sourcing a shell-side fluid for heat exchanger unit 200.

Both the shell-side fluid and tube-side fluid flow paths are indicated by the directional flow arrows shown in FIG. 7 and comport with the countercurrent flow arrangement depicted in FIGS. 1 and 2, as previously described herein. It will not be repeated here for sake of brevity.

The two basic T-shaped heat exchangers 100 combined in the heat exchanger unit 200 of FIG. 7 may be of the same or different size/heat transfer capacity depending on the particular application needs. FIG. 7 shows an example of two different size heat exchangers 100 each with different diameter longitudinal and transverse shells than the other that have been combined and joined via the common transverse shell 201. In such an embodiment, a reducer 211 may be provided between the larger diameter portion of the transverse shell 201 associated with longitudinal shell 202 on the right and the smaller diameter portion of the transverse associated with longitudinal shell 203 on the left. In other possible embodiments, a single diameter transverse shell 201 may be provided even if the individual heat exchanger 100 used in heat exchanger unit 200 have different diameters thereby eliminating the reducer. Because the two tube bundles 150-1, 150-2 will have different outer diameters (defined collectively by the individual tubes 157 in each bundle), this latter single diameter transverse shell might not be optimum to extract the most heat from the shell-side fluid in the smaller diameter heat exchanger 100.

Figure 8:
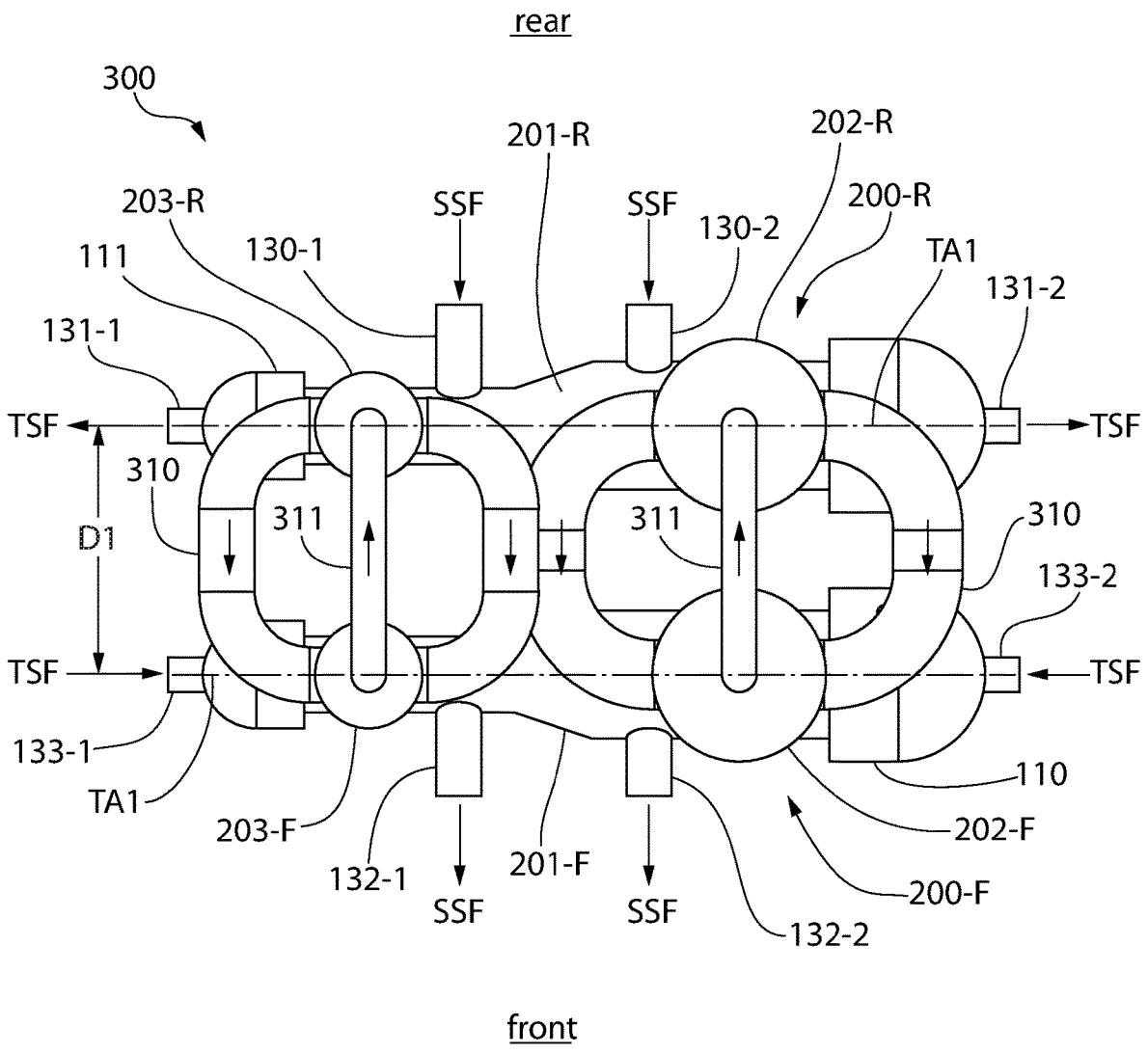
FIG. 8 is top plan view of a heat exchanger system combining two heat exchanger units of FIG. 7.
Figure 9:
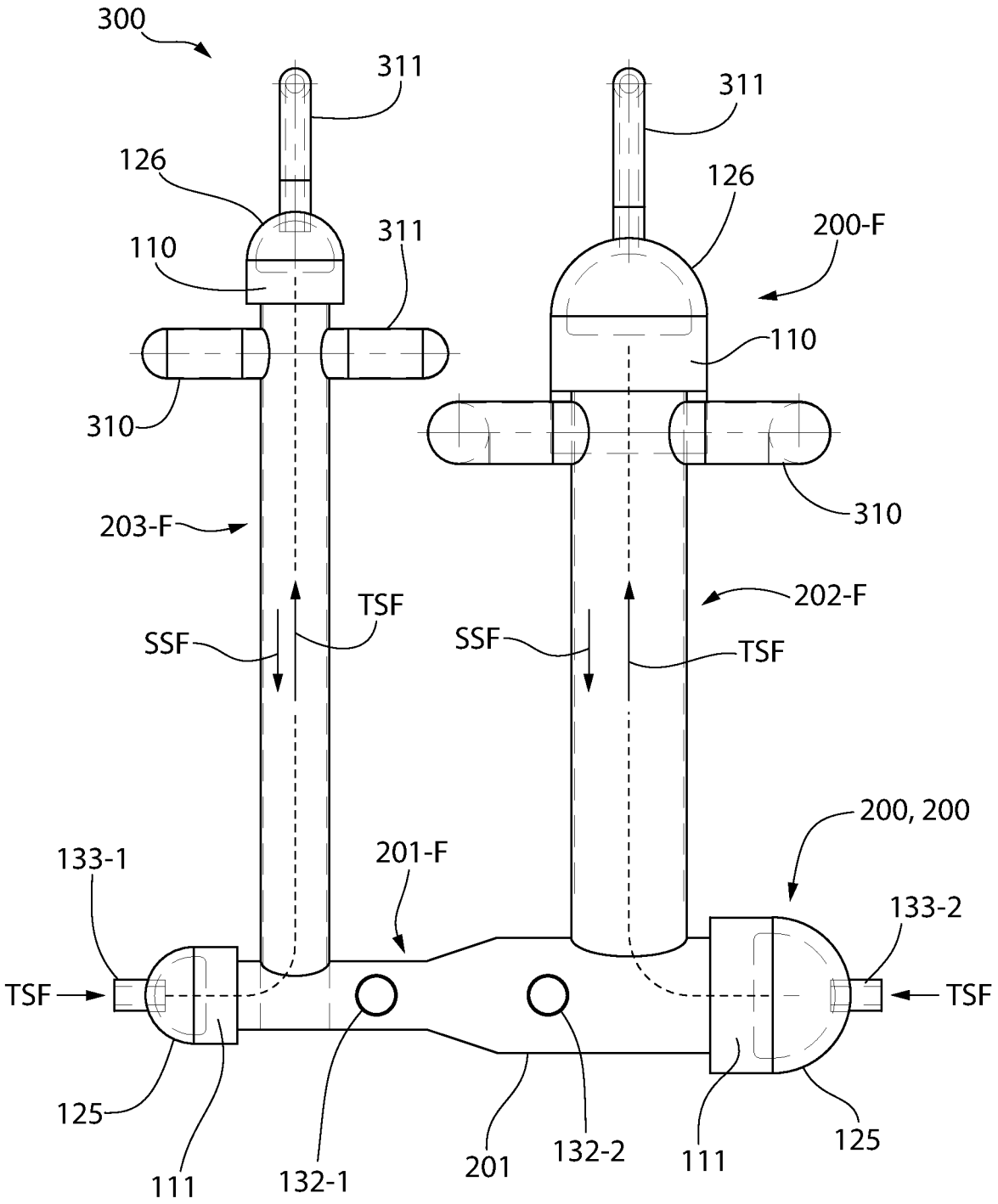
FIG. 9 is front view thereof.
Figure 10:
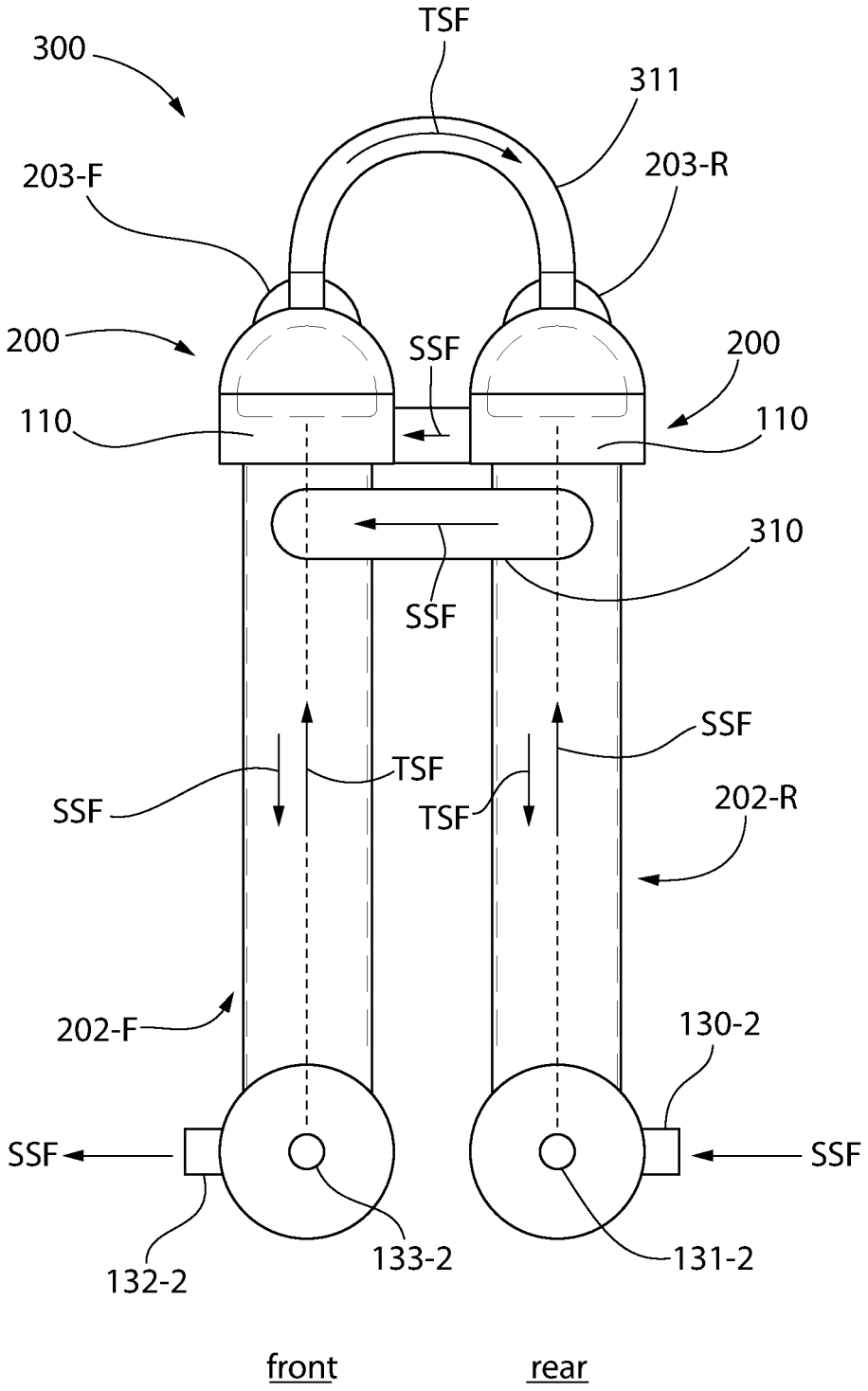
FIG. 10 is a right side view thereof.

According to another aspect of the invention, the dual heat exchanger assembly or unit 200 of FIG. 7 may be used in turn to construct a modular heat exchanger system 300 comprising two or more heat exchanger units 200. FIGS. 8-10 shows a non-limiting exemplary arrangement of a modular heat exchanger system 300 combining two heat exchanger units 200 to provide a set of four J-tube heat exchangers 100 in total. The J-tube heat exchangers can be installed in at least partial series flow arrangement to facilitate the segregation of heat exchanger materials commensurate with their strength versus temperature capabilities for the shell-side and tube-side fluids encountered. The number of tubes 157 in each shell, tube diameter, and tube material as well as the shell diameters may each be the same or different in the multiple heat exchanger unit to provide design flexibility.

In some embodiments, both low and high pressure heat exchangers may be combined in a single assembly of a modular heat exchanger system 300 when at least the shell-side fluids are isolated using flow partition plates 210 in the transverse shells 201 as previously described herein. As shown in FIGS. 8-10, as one non-limiting example, the smaller diameter shells shown may correspond to higher shell-side pressure heat exchangers and the larger diameter shells shown may correspond to lower shell-side pressure heat exchangers. Because the higher pressure heat exchangers receive a shell-side fluid (e.g. steam, liquid water, or other fluid) that will generally have a higher temperature and pressure, the thermal energy in this fluid is greater requiring less tube surface area to effectively heat the tube-side fluid with the shell-side fluid to the desired temperature. The tube bundles in higher pressure heat exchangers may therefore comprise a smaller number of tubes to achieve the desired heat transfer which translates into a smaller diameter shell requirement.

For convenience of reference, the pair of heat exchanger units 200 combined in FIGS. 8-10 will be described as a "front" unit 200-F and a "rear" unit 200-R for convenience of reference in describing the modular heat exchanger system 300. Each heat exchanger unit may be shop prefabricated in whole or at least partially and shipped to the installation site. Advantageously, this reduces field work and allows a majority of the heat exchanger units to be fabricated under controlled factory conditions.

Front heat exchanger unit 200-F includes longitudinal shells 202-F and 203-F axially spaced apart on the common front transverse shell 201-F. Similarly, rear heat exchanger unit 200-R includes longitudinal shells 202-R and 203-R axially spaced apart on the common front transverse shell 201-R. Transverse shells 201-F, 201-R may be shaped similarly to common transverse shell 201 shown in FIG. 7. The heat exchanger units 200-F, 200-R are preferably closely coupled together and tightly spaced apart to form an integrated compact multi-heat exchanger assembly or unit amenable to complete or partial shop prefabrication. This is distinct from merely fluidly connecting several discrete heat exchanger together via long piping runs as in past heat exchanger installation practices in the power generation industry which consume a significant amount of valuable and limited available floor space. For example, in some preferred embodiments the front and rear transverse shells 201-F, 201-R may be spaced apart by a distance D1 measured between their respective transverse axes TA1 which is less than 4 times the largest diameter of the transverse shells, preferably less than 3 times the largest diameter. In a certain example, distance D1 may be about 2 times the largest diameter as shown in FIG. 8.

Advantageously, the multi-unit heat exchanger system 300 therefore combines several heat exchangers into a single compact package having a relatively small footprint attributable in part to the direct coupling of some of the transverse shells together as described herein. This preserves valuable available space within the power generation or other plant for other system equipment.

With reference to FIG. 7 showing the basic heat exchanger unit 200 and FIGS. 8-10, the front heat exchanger unit 200-F includes a pair of opposed tube-side fluid inlet nozzles 133-1, 133-2 and a pair of shell-side fluid outlet nozzles 132-1, 132-2. The rear heat exchanger unit 200-R includes a pair of opposed tube-side fluid outlet nozzles 131-1, 131-2 and pair of shell-side fluid inlet nozzles 130-1, 130-2. The arrangement of heads 125, 126 and tubesheets 110, 111 is shown in FIG. 7.

In the foregoing figures, the two larger shell diameter longitudinal shells 202-F, 202-R are fluidly coupled together on both the shell-side and tube-side by external cross flow piping segments 310, 311. The shell-side cross flow piping segments are designated 310 and the tube-side cross flow piping segments are designated 311. The two smaller diameter longitudinal shells 203-F, 203-R are similarly fluidly coupled together by external cross flow piping segments 310, 311. The flow arrows show the flow direction of both the shell-side and tube-side fluids. Each of the cross flow piping segments 310, 311 may be U-shaped piping segments, which may preferably be shop fabricated as piping spools for preferably field welding and/or flanged/bolted connection directly to their respective nozzles of longitudinal shells. The tube-side cross flow piping segments 311 may be vertically oriented as shown in one embodiment. The shell-side cross flow piping segments 310 may be horizontal oriented as shown in one embodiment. Any suitable type of metal such as preferably steel piping may be used for the cross flow piping segments.

In some embodiments, partition plates 210 as previously described herein may be disposed inside both front and rear common transverse shells 201-F, 201-R to fluidly isolate the shell-side fluids flowing the longitudinal shells 202-F, 202-R and the longitudinal shells 203-F, 203-R. The partition plate option is useful when combining both low and high pressure heat exchangers in the multi-unit modular heat exchanger assembly or system 300.

It bears noting the pairs of transverse shells 201-F, 201-R, larger diameter longitudinal shells 202-F, 202-R, and smaller diameter longitudinal shells 203-F, 203-R need not be identical in diameter, exterior dimensions (height/length), and/or configuration in each pair as shown in FIGS. 8-10. Accordingly, they may be customized and different in certain other embodiments to fit a particular application need.

Figure 11:
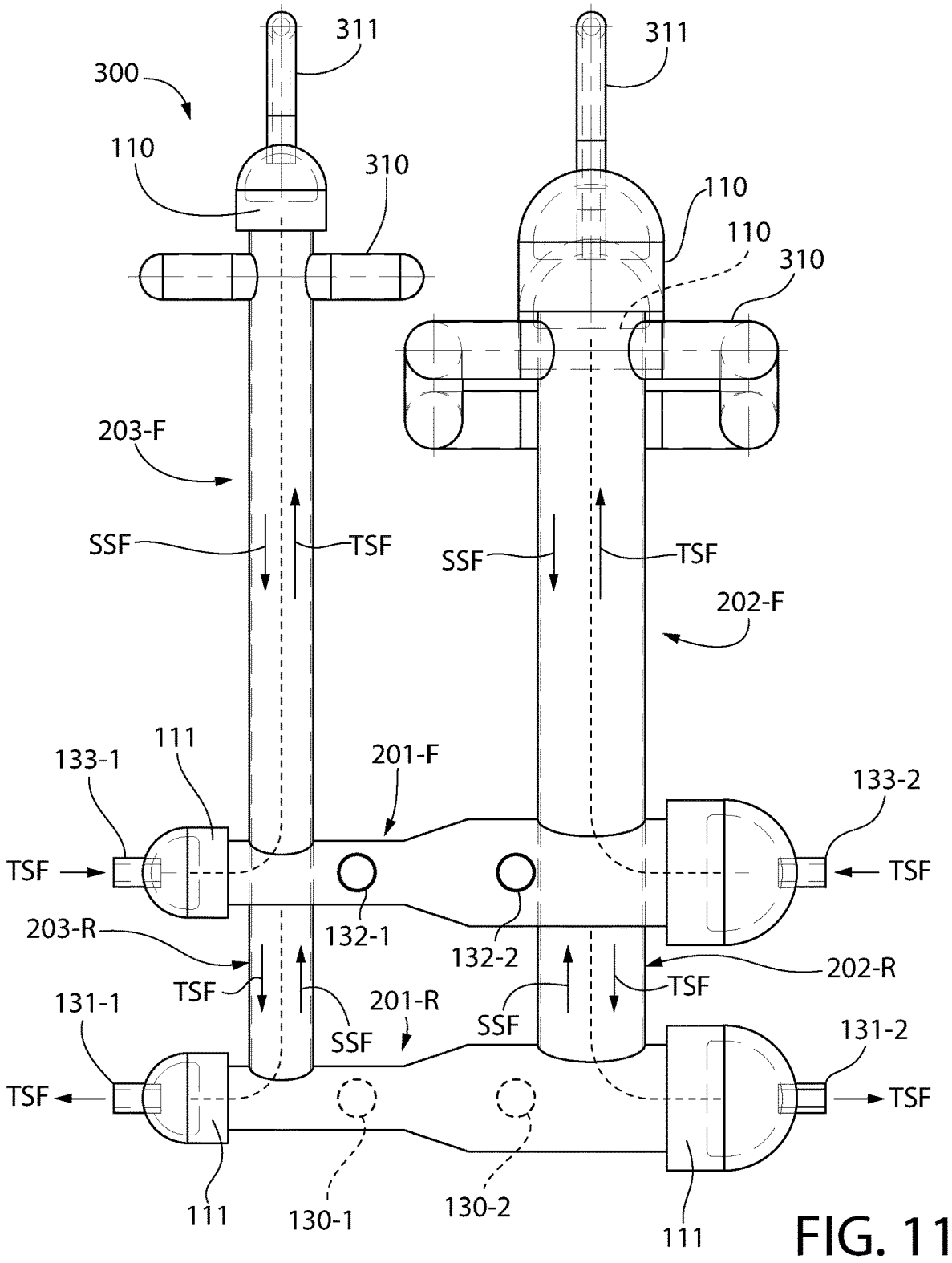
FIG. 11 is a front view thereof showing an alternative arrangement of vertically offset front and rear common transverse shells.
Figure 12:
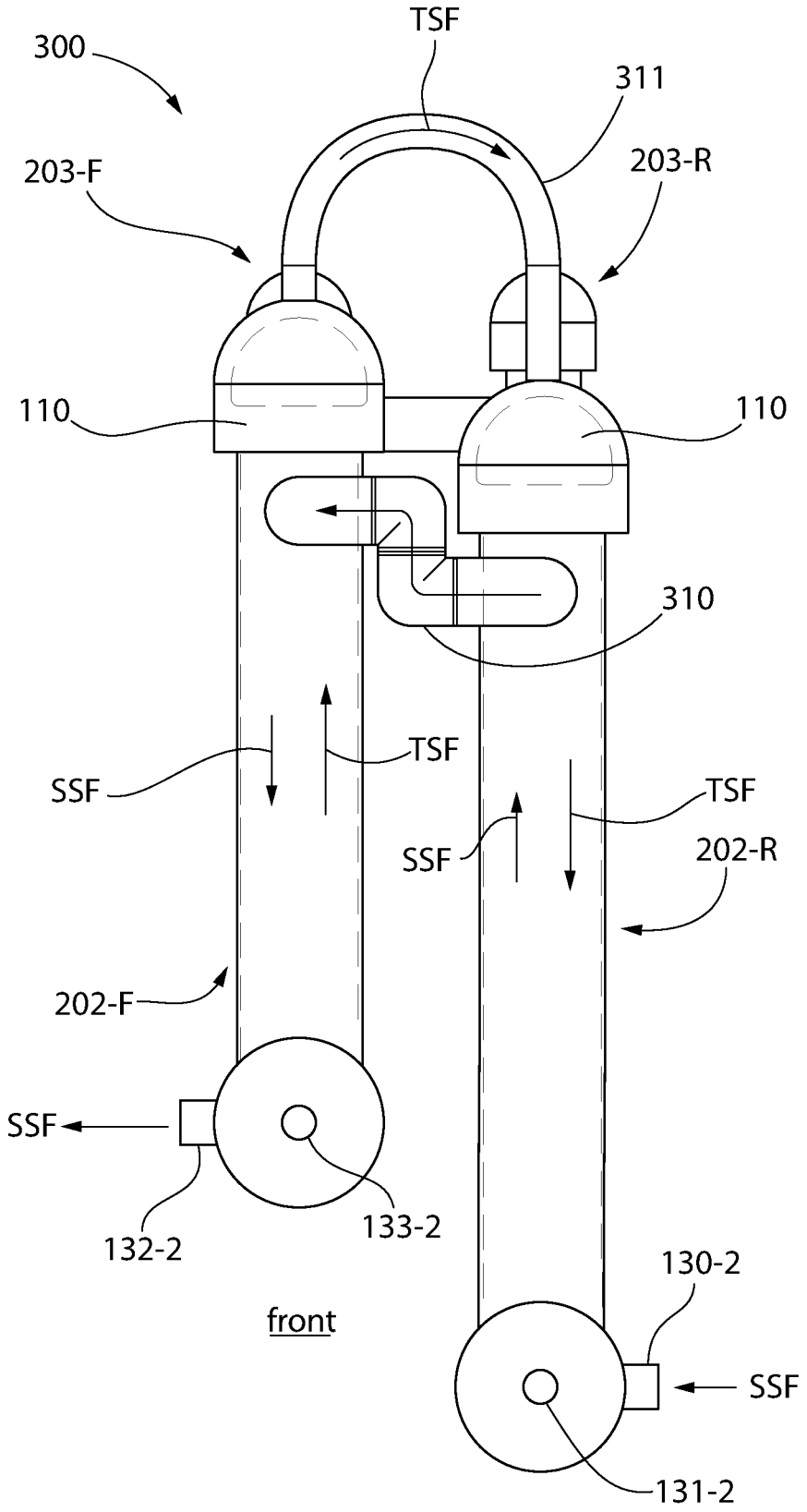
FIG. 12 is right side view of the alternative arrangement.
Figure 13:
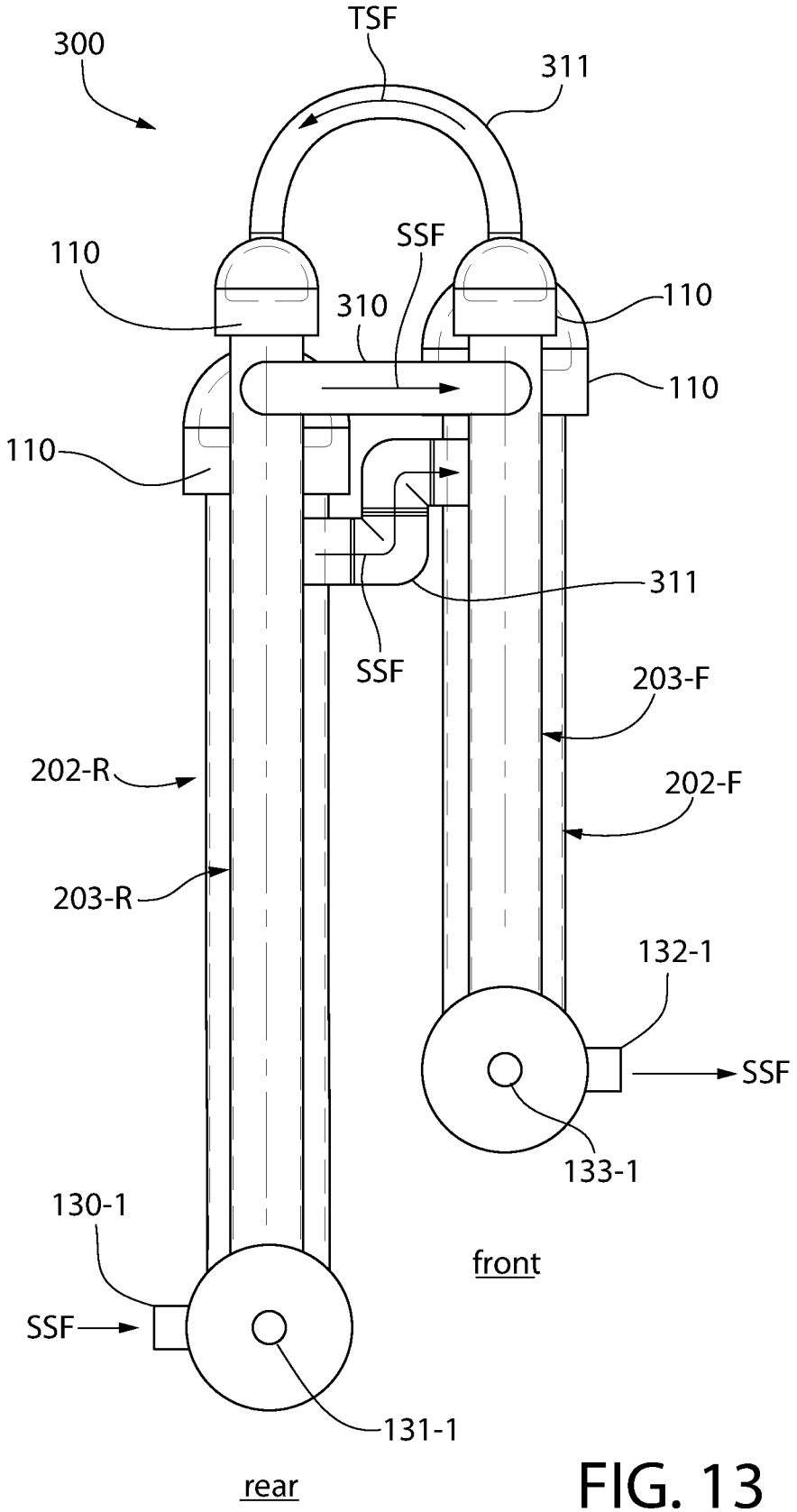
FIG. 13 is a left side view of the alternative arrangement.
Figure 14:
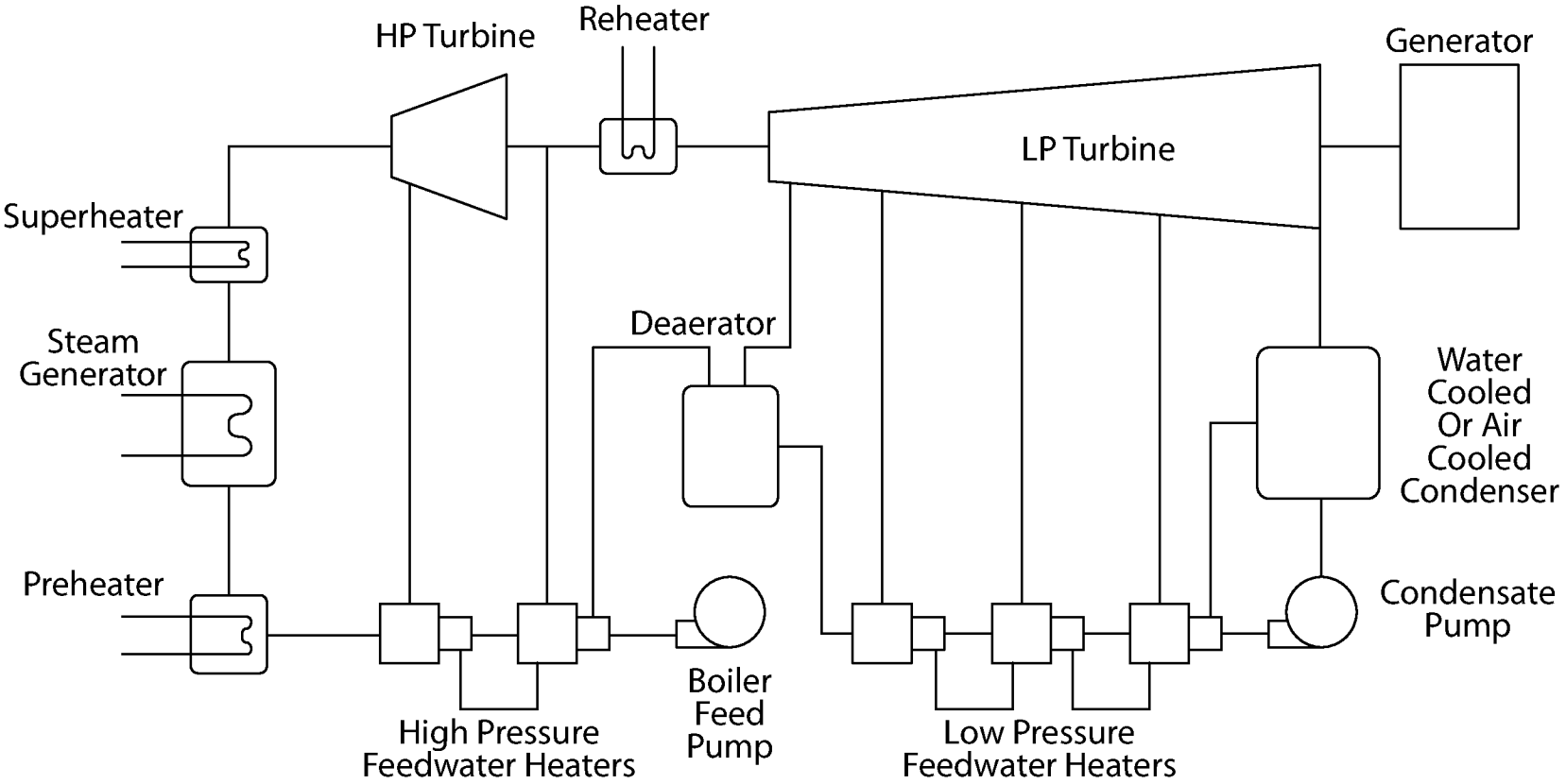
FIG. 14 is a schematic diagram of a Rankine power generation cycle.

In FIGS. 8-10, the common traverse shells 201-F, 201-R are arranged at the same elevation. This may be acceptable for new installations. However, in other embodiments the common transverse shells 201-F, 201-R may instead be located at different elevations relative to each other as shown in FIGS. 11-13. Some of the longitudinal shells may be vertically offset from each other if not compensated for by a decrease/increase in height/length. As an example, the two larger diameter longitudinal shells 202-F, 202-R are depicted as vertically offset such that the cross piping segment 311 is will require a pair of 90 degree elbows as shown due to the SSF outlet nozzles 132 being vertically offset. Such an alternative arrangement as shown in FIGS. 11-13 may be useful or required in retrofit applications to avoid existing building structure and equipment. In top view, this alternative embodiment would appear the same as in FIG. 8 which should be referenced additionally. In short, the modular heat exchanger system 300 has considerable flexibility in design to accommodate a variety of installation requirements. This latter alternative arrangement is constructed in accordance with same principles and features already described herein for heat exchanger system of FIGS. 8-10, which will not be repeated here for sake of brevity.

The heat exchangers 100, dual heat exchanger unit 200, and modular heat exchanger system 300 may be supported in any manner via suitable structural supports mounted to the flooring, decks, or superstructure. Use of spring type supports to reduce thermal constraint, while supporting heat exchanger weight may be used, in conjunction with selection of sufficiently flexible interconnecting pipe spools used for the cross flow piping connections.

The heat exchangers 100, dual heat exchanger unit 200, and modular heat exchanger system 300 disclosed herein may be used in numerous applications where it is intended to heat/cool a first tube-side fluid with a second shell-side fluid. In one application, the present heat exchangers may be used in a nuclear power, fossil fuel, biomass, solar, or power generation station operating a Rankine cycle for electric power production (see, e.g. FIG. 142). The present heat exchanger or multi-unit heat exchangers may be used for any or all of the high and/or lower pressure feedwater heaters depicted using water as the tube-side fluid and steam as the shell-side fluid. The present heat exchangers however may be used in numerous other applications and industry for fluid heating applications, such as for example without limitation petroleum refining, chemical production plants, or various industrial applications. Accordingly, the invention is not limited to any particular application alone in its scope or applicability.

Additional advantages of the heat exchangers 100 and 200 disclosed herein include: a compact space requirement; maximum flexibility with respect to installation and orientation; reduced risk of severe stresses from restraint of thermal expansion; ability to withstand thermal and pressure transients is enhanced; and the shell-side pressure loss in the flow stream is minimized for optimal heat transfer performance by use of non-segmental baffles.

While the foregoing description and drawings represent preferred or exemplary embodiments of the present invention, it will be understood that various additions, modifications and substitutions may be made therein without departing from the spirit and scope and range of equivalents of the accompanying claims. In particular, it will be clear to those skilled in the art that the present invention may be embodied in other forms, structures, arrangements, proportions, sizes, and with other elements, materials, and components, without departing from the spirit or essential characteristics thereof. In addition, numerous variations in the methods/processes as applicable described herein may be made without departing from the spirit of the invention. One skilled in the art will further appreciate that the invention may be used with many modifications of structure, arrangement, proportions, sizes, materials, and components and otherwise, used in the practice of the invention, which are particularly adapted to specific environments and operative requirements without departing from the principles of the present invention. The presently disclosed embodiments are therefore to be considered in all respects as illustrative and not restrictive, the scope of the invention being defined by the appended claims and equivalents thereof, and not limited to the foregoing description or embodiments. Rather, the appended claims should be construed broadly, to include other variants and embodiments of the invention, which may be made by those skilled in the art without departing from the scope and range of equivalents of the invention.

What is claimed is:

1. A heat exchanger comprising:

an elongated longitudinal shell defining a first shell-side space and a longitudinal axis;

an elongated transverse shell defining a second shell-side space and a transverse axis; the transverse shell oriented perpendicularly transversely to the longitudinal shell;

the transverse shell fluidly coupled to a first end of the longitudinal shell such that the second shell-side space is in fluid communication with the first shell-side space;

a tube bundle extending through the first and second shell-side spaces, the tube bundle comprising a plurality of tubes each having a first end coupled to a first tubesheet in the first shell-side space of the first longitudinal shell and a second end coupled to a second tubesheet in the second shell-side space of the transverse shell;

wherein the first and second tube-sheets are oriented non-parallel to each other;

wherein the tubes each include a straight short section disposed in the transverse shell and fluidly coupled to the second tubesheet, a straight long section disposed in the longitudinal shell and fluidly coupled to the first tubesheet, and a radiused tube bend therebetween;

wherein the transverse shell includes a tubeless space defining an auxiliary shell-side flow plenum at a first end portion of the transverse shell opposite a second end portion of the transverse shell attached to the second tubesheet, and a shell-side inlet nozzle on the transverse shell is coupled to the first end portion and arranged to introduce a shell-side fluid directly into the auxiliary flow plenum such that the shell-side fluid expands and undergoes a reduction in velocity before impinging the tubes in the transverse shell;

a shell-side fluid inlet head sealably joined to the first end portion of the transverse shell and a tube-side fluid outlet head sealably joined to the second tubesheet in the transverse shell;

wherein the longitudinal shell includes a shell-side outlet nozzle oriented perpendicularly to the shell-side inlet nozzle;

wherein the shell-side inlet nozzle is configured to direct the shell-side fluid towards the radiused tube bend of each tube; and wherein the shell-side fluid auxiliary flow plenum in the transverse shell has an axial length DV measured along the transverse axis which extends from a terminal end of the shell-side fluid inlet head to a nearest point on the transverse shell where the longitudinal shell is attached to the transverse shell, the axial length DV being at least one quarter of a total axial length of the transverse shell measured along the transverse axis between the terminal end of the shell-side fluid inlet head to a second terminal end of the tube-side fluid outlet head to provide space for expanding the inlet shell-side fluid.

2. The heat exchanger according to claim 1, wherein the longitudinal shell is coupled to the transverse shell inwards of and between opposing ends of the transverse shell.

3. The heat exchanger according to claim 2, wherein the longitudinal shell is oriented perpendicularly to the transverse shell forming a T-shaped heat exchanger.

4. The heat exchanger according to claim 3, wherein the longitudinal shell includes a tube-side inlet nozzle coaxially aligned with the longitudinal axis and a radial shell-side outlet nozzle transversely oriented to the longitudinal axis.

5. The heat exchanger according to claim 4, wherein the shell-side outlet nozzle is located proximate to the first tubesheet.

6. The heat exchanger according to claim 4, wherein the transverse shell includes a tube-side outlet nozzle coaxially aligned with the transverse axis at a first one of the ends of the transverse shell, and the shell-side inlet nozzle coaxially aligned with the transverse axis at a second one of the ends of the transverse shell.

7. The heat exchanger according to claim 1, wherein the tubes are J-shaped collectively giving the tube bundle the same configuration.

8. The heat exchanger according to claim 1, wherein the shell-side fluid flows into the auxiliary flow plenum from the shell-side inlet nozzle in an axial direction parallel to transverse axis of the transverse shell, and the shell-side fluid turns 90 degrees in the auxiliary plenum to enter the longitudinal shell.

9. The heat exchanger according to claim 1, wherein the first tubesheet includes a first end portion having a first diameter, a second end portion having a second diameter, and an annular angled transition portion between the first and second end portions.

10. The heat exchanger according to claim 1, further comprising a planar flow blocker plate oriented parallel to and spaced apart from an inboard face of the second tubesheet, the flow blocker plate sealably welded to the transverse shell forming a dead flow space between the second tubesheet and the flow blocker plate.

11. The heat exchanger according to claim 1, further comprising a tube-side fluid inlet head sealably joined to the first tubesheet at a second end of the longitudinal shell to form a tube-side inlet flow plenum.

12. The heat exchanger according to claim 11, further comprising a radially extending first shell-side outlet nozzle on the longitudinal shell which is oriented perpendicularly to the longitudinal axis of the longitudinal shell, and a radially-extending second shell-side outlet nozzle on the longitudinal shell opposite the first shell-side outlet nozzle, the first and second shell-side outlet nozzles being configured to discharge the shell-side fluid in opposite directions.

13. The heat exchanger according to claim 12, wherein a tube-side fluid flows through the longitudinal shell in a first axial direction, and the tube-side fluid flows through the transverse shell in a second axial direction perpendicular to the first axial direction.

14. The heat exchanger according to claim 13, wherein the tube-side fluid flows in a countercurrent arrangement to a shell-side fluid flowing through the longitudinal and transverse shells.

15. The heat exchanger according to claim 1, wherein the shell-side inlet and outlet nozzles have respective diameters larger than the tubes of the tube bundle.

16. A method for reducing tube-side erosion in the heat exchanger according to claim 1, the method comprising introducing the shell-side fluid through the shell-side inlet nozzle directly into the auxiliary flow plenum, expanding the shell-side fluid, and reducing the velocity of the shell-side fluid before impinging the tubes in the second transverse shell.

17. A heat exchanger comprising:

an inlet tubesheet and an outlet tubesheet;

an elongated longitudinal shell assembly defining a first shell-side space and a longitudinal axis;

the longitudinal shell assembly comprising opposing first and second ends, a circumferential sidewall extending between the first and second ends, a tube-side fluid inlet nozzle fluidly coupled to the inlet tubesheet, and a shell-side fluid outlet nozzle fluidly coupled to the circumferential sidewall;

an elongated transverse shell assembly fluidly coupled to the first end of the longitudinal shell, the transverse shell assembly defining a second shell-side space and a transverse axis oriented perpendicularly to the longitudinal axis of the longitudinal shell, the second shell-side space being in direct fluid communication with the first shell-side space;

the transverse shell assembly comprising opposing first and second ends, a circumferential sidewall extending between the first and second ends, a tube-side fluid outlet nozzle fluidly coupled to the outlet tubesheet, and a shell-side fluid inlet nozzle;

a J-shaped tube bundle extending through the first and second shell-side spaces between the inlet and outlet tubesheets, the tube bundle comprising a plurality of tubes each having a first end fluidly coupled to the inlet tubesheet in the first shell-side space of the longitudinal shell and a second end fluidly coupled to the outlet tubesheet in the second shell-side space of the transverse shell;

a tube-side fluid flowing through the tube bundle and a shell-side fluid flowing through the longitudinal and transverse shell assemblies;

wherein the first and second tube-sheets are oriented non-parallel to each other;

wherein the tubes each include a straight short section disposed in the transverse shell and fluidly coupled to the second tubesheet, a straight long section disposed in the longitudinal shell and fluidly coupled to the first tubesheet, and a radiused tube bend therebetween;

wherein the transverse shell includes a tubeless space defining an auxiliary shell-side flow plenum at a first end portion of the transverse shell opposite a second end portion of the transverse shell attached to the second tubesheet, and a shell-side inlet nozzle on the transverse shell is coupled to the first end portion and arranged to introduce a shell-side fluid directly into the auxiliary flow plenum such that the shell-side fluid expands and undergoes a reduction in velocity before impinging the tubes in the transverse shell;

a shell-side fluid inlet head sealably joined to the first end portion of the transverse shell and a tube-side fluid outlet head sealably joined to the second tubesheet in the transverse shell;

wherein the longitudinal shell includes a shell-side outlet nozzle oriented perpendicularly to the shell-side inlet nozzle;

wherein the shell-side inlet nozzle is configured to direct the shell-side fluid towards the radiused tube bend of each tube; and wherein the shell-side fluid auxiliary flow plenum in the transverse shell has an axial length DV measured along the transverse axis which extends from a terminal end of the shell-side fluid inlet head to a nearest point on the transverse shell where the longitudinal shell is attached to the transverse shell, the axial length DV being at least one quarter of a total axial length of the transverse shell measured along the transverse axis between the terminal end of the shell-side fluid inlet head to a second terminal end of the tube-side fluid outlet head to provide space for expanding the inlet shell-side fluid.

18. The heat exchanger according to claim 17, wherein the tube-side fluid flows through the longitudinal shell assembly in a first axial direction, and the tube-side fluid flows through the transverse shell assembly in a second axial direction perpendicular to the first axial direction.

19. The heat exchanger according to claim 18, wherein the tube-side fluid flows in a countercurrent arrangement to the shell-side fluid flowing through the longitudinal and transverse shell assemblies.

20. The heat exchanger according to claim 17, wherein the shell-side inlet and outlet nozzles have respective diameters larger than the tubes of the tube bundle.

21. A method for reducing tube-side erosion in the heat exchanger according to claim 17, the method comprising introducing the shell-side fluid through the shell-side inlet nozzle directly into the auxiliary flow plenum, expanding the shell-side fluid, and reducing the velocity of the shell-side fluid before impinging the tubes in the second transverse shell.

* * * * *